United States Patent [19]

Boland et al.

[11] Patent Number: 4,779,932

[45] Date of Patent: Oct. 25, 1988

[54] BRISTLE FILLED SLEEVE AND METHOD OF FILLING AND USING SAME

[75] Inventors: Anthony C. Boland, San Marino; George R. Maxwell, Altadena, both of Calif.

[73] Assignee: L.A. Brush Manufacturing Corp., Los Angeles, Calif.

[21] Appl. No.: 133,494

[22] Filed: Dec. 14, 1987

Related U.S. Application Data

[63] Continuation of Ser. No. 853,744, Apr. 18, 1986, abandoned, which is a continuation-in-part of Ser. No. 682,552, Dec. 17, 1984, abandoned.

[51] Int. Cl.[4] ..... A46D 1/04

[52] U.S. Cl. ..... 300/21; 29/430; 29/525.1

[58] Field of Search ..... 29/429, 430, 431, 791, 29/792, 822, 564.1, 564.2, 564.7, 564.8, 566, 566.1, 33 K, 33 J, 526 R; 300/21, 2, 3, 4, 5, 10, 11; 15/179, 181

[56] References Cited

U.S. PATENT DOCUMENTS

| | | | |
|---|---|---|---|
| 2,031,658 | 2/1936 | Jones | 300/3 |
| 3,106,737 | 10/1963 | Schofield | 15/181 |
| 3,245,554 | 4/1966 | Zahoransky | 414/739 |
| 3,339,983 | 9/1957 | Maxner et al. | 300/3 |
| 3,574,880 | 4/1971 | Butzen | 15/179 |

*Primary Examiner*—Howard N. Goldberg
*Assistant Examiner*—Joseph M. Gorski
*Attorney, Agent, or Firm*—William W. Haefliger

[57] ABSTRACT

A cylindrical brush is formed to have multiple interfitting and interconnected sections which may consist of synthetic resin; holes are controllably and automatically drilled in the sections in selected patterns so that bristles may be filled into certain holes to be retained by staples; other holes may be controllably drilled into the sections and shaped to supply fluid radially outwardly for cleaning bristles or for cleaning work, or drying or waxing same; holes may be formed at telescoping end extents of the sections; bristles may be anchored by staples with legs deflected by a mandrel or shaft; and staples may act to lock telescoping sections of a sleeve or core, assisted by bonding of the plastic sections.

12 Claims, 18 Drawing Sheets

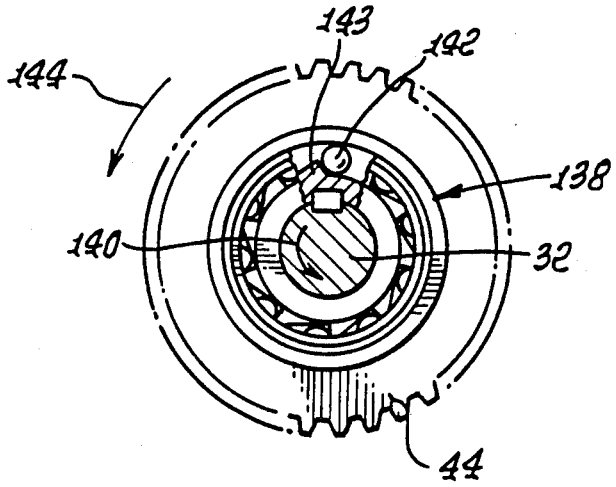
FIG. 7.
FIG. 5.
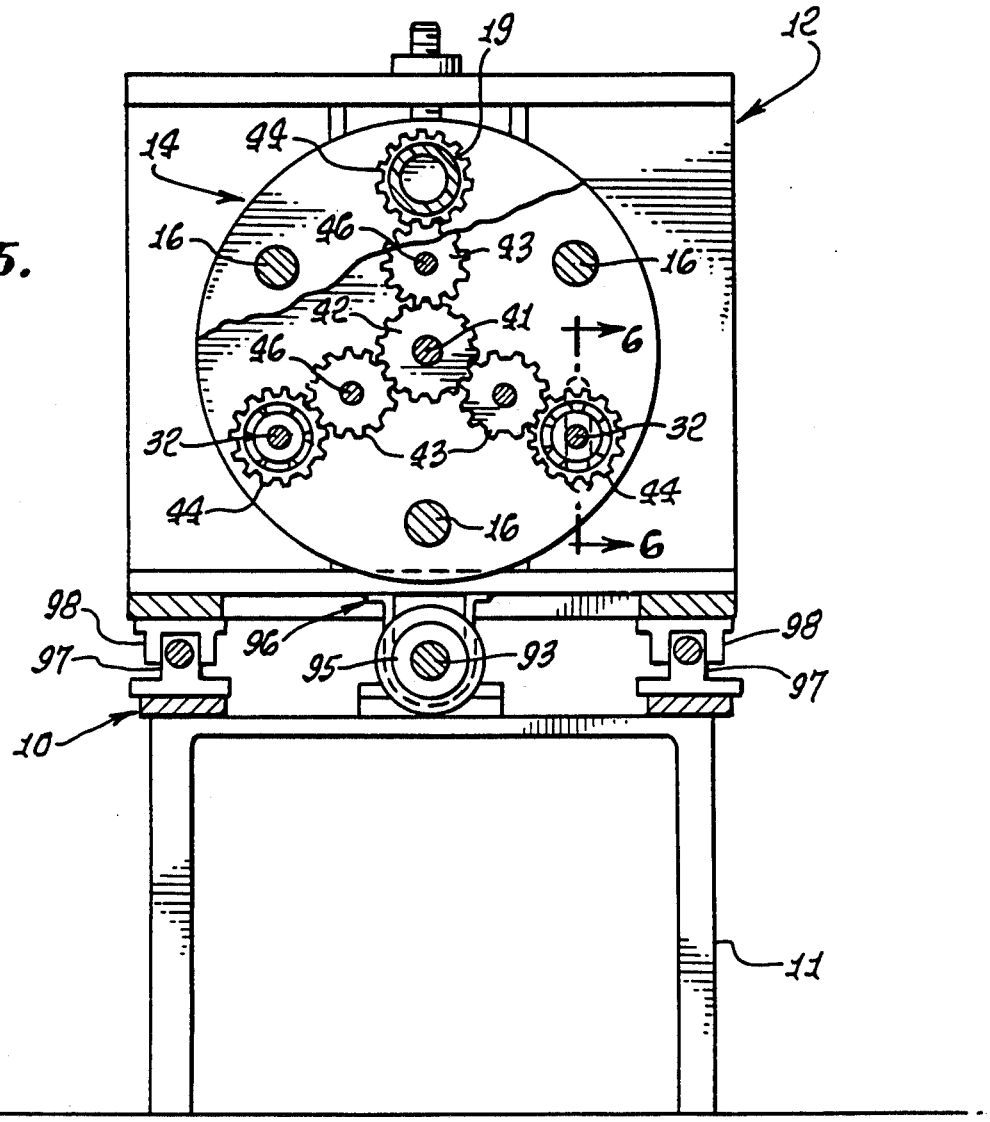

BRISTLE FILLED SLEEVE AND METHOD OF FILLING AND USING SAME

This is a continuation of application Ser. No. 853,744, now abandoned, filed 4-18-86, which is a continuation-in-part application of Ser. No. 682,552, filed 12-17-84, now abandoned.

BACKGROUND OF THE INVENTION

This invention relates generally to brush making, and more specifically to an automatic process for filling bristles into elongated tubular synthetic resinous cores and in such manner that the filled core may be employed as a replacement.

There is a continuing demand for rotary brushes especially of large size, of various diameters, and axial lengths, bristle concentrations per unit brush area, and bristle lengths. Along with this demand, there is need for an efficient, easily performed process to produce such brushes, of selected and different bristle configurations, as for example have cores of considerable lengths—6–12 feet for example, and which may be employed as replacements, to be thrown away after use. This obviates the costly process of re-filling customers' heavy metallic cores at a distance from point of use. Also, there is need for high quality brushes, of selectable bristle configurations, produced as by such process.

SUMMARY OF THE INVENTION

It is a major object of the invention to provide a process for selectivity, rapidly and controllably filling bristles into non-reusable brush cores made of synthetic resinous material, and which fit onto customers' driven shafts. Basically, the brush comprises:

(a) and axially elongated, substantially cylindrical core sleeve consisting of synthetic resin, the sleeve having a bore, (b) holes formed in the core sleeve, to extend inwardly from the outer surface thereof, and in a preselected pattern, spaced lengthwise of the core and about the core axis, (c) bristles filled into said holes and retained therein, at the bottoms of the holes, and (d) the sleeve comprising multiple sleeve sections extending coaxially and having end extents extending in mutually telescoping relation.

As will appear, staples retain the bristles to the bottoms of the holes, the staples having legs which extend inwardly below the bottoms of the holes, the legs having end portions deflected laterally to extend generally tangentially to the sleeve bore, thereby to anchor the staples to the core sleeve; and the formed holes spiral about the sleeve axis with continuity from one section to the next; and telescoping sections may be interconnected by staples. The brush filling process basically includes the steps:

(a) forming holes in thecore sleeve to extend inwardly from the outer surface of the sleeve, and in a pre-selected pattern spaced lengthwise of the core and about the core axis, (b) filling the bristles into the holes to be retained at the bottom of said holes, and to project outwardly from said holes, and (c) driving the staples into the core sleeve inwardly of the bottoms of the holes and to retain the bristles to the hole bottoms, the staples having legs with end portions, (d) and wherein the core sleeve comprises multiple sleeve sections, and including telescopically interfitting said sections to form the core sleeve to selected length.

This process may also include the steps:

(e) mounting the core sleeve on a mandrel that extends axially within and adjacent to the sleeve bore, and (f) driving staple leg end portions against the mandrel and tangentially of the sleeve bore, but within the sleeve material.

The core or sleeve multiple sections may be telescopically interfitted on a removable mandrel extending therein, and the telescoping extents of the sections may be interlocked by the staples which retain the bristles to the telescoping extents, as will appear.

Further objects include supplying fluid to the sleeve for exit via holes at or near bristles; and use of such fluid supplied brushes for cleaning articles, as will appear.

It is a yet further object to mount multiple core sleeves at first positions, and to rotate the cores at second and third positions, and relative to mounting heads, whereby holes may be selectively drilled at angularly spaced locations, and bristles may be filled into the holes, and stapled into position as described.

These and other objects and advantages of the invention, as well as the details of an illustrative embodiment, will be more fully understood from the following specification and drawings, in which:

DRAWING DESCRIPTION

FIGS. 1*a* and 1*b* are plan view of apparatus embodying the invention, and specifically left and right respectively of that apparatus;

FIGS. 2*a* and 2*b* are elevations of the FIGS. 1*a* and 1*b* apparatus, and taken on lines 2—2 of FIGS. 1*a* and 1*b;*

FIG. 5 is an enlarged section taken in section on lines 5—5 of FIG. 3;

FIG. 7 is a section on lines 7—7 of FIG. 6;

Figure 18:
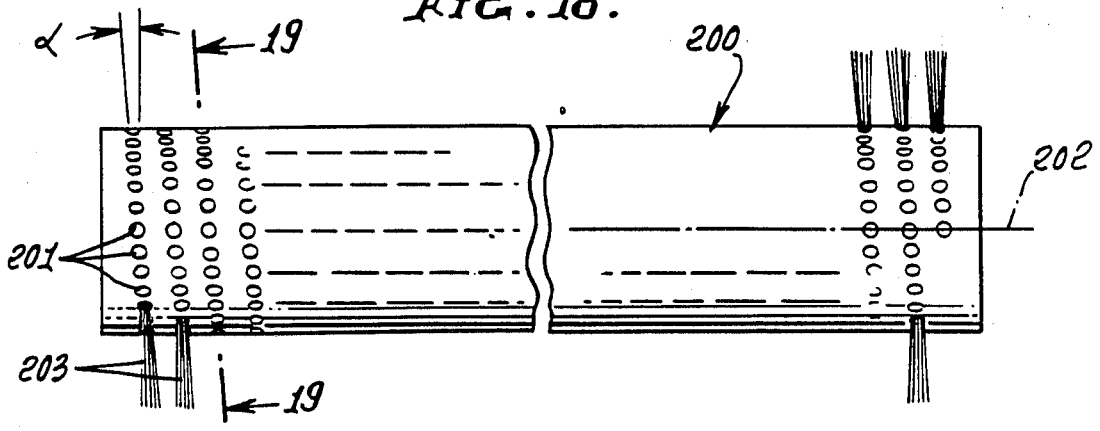
FIG. 18 is a front elevation showing a brush produced by the process and application of the invention.
Figure 27:
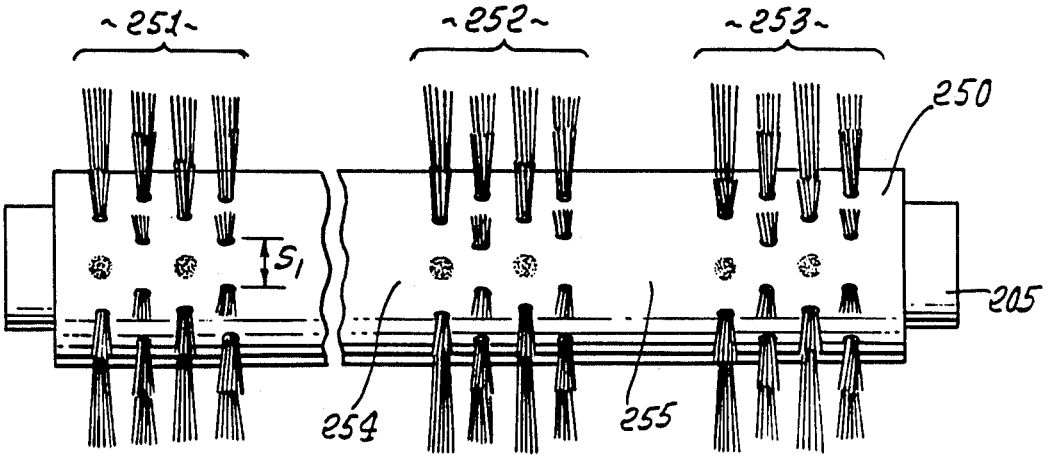
Figure 21:
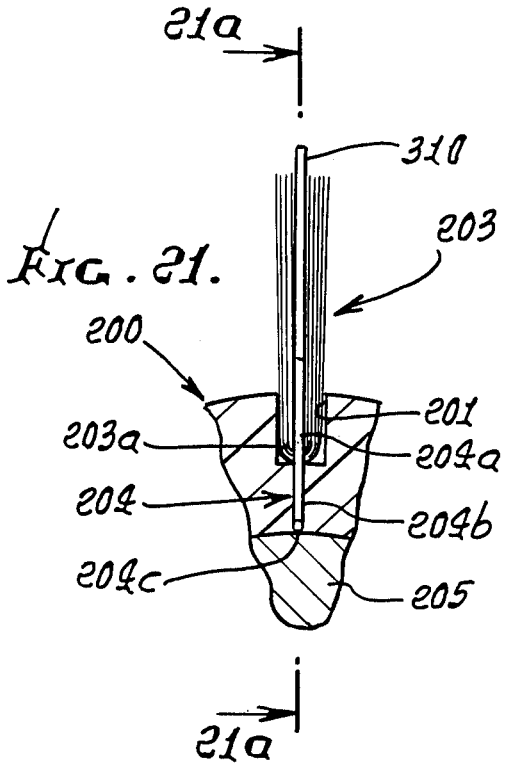
FIG. 21 is an enlarged fragmentary section showing anchoring of bristles in a core hole and employing a mandrel.
Figure 21A:
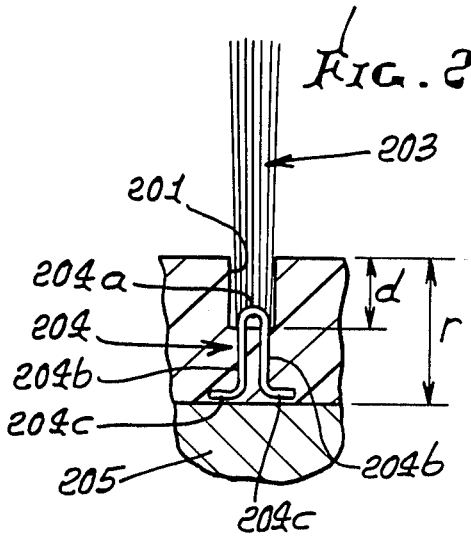
Figure 22:
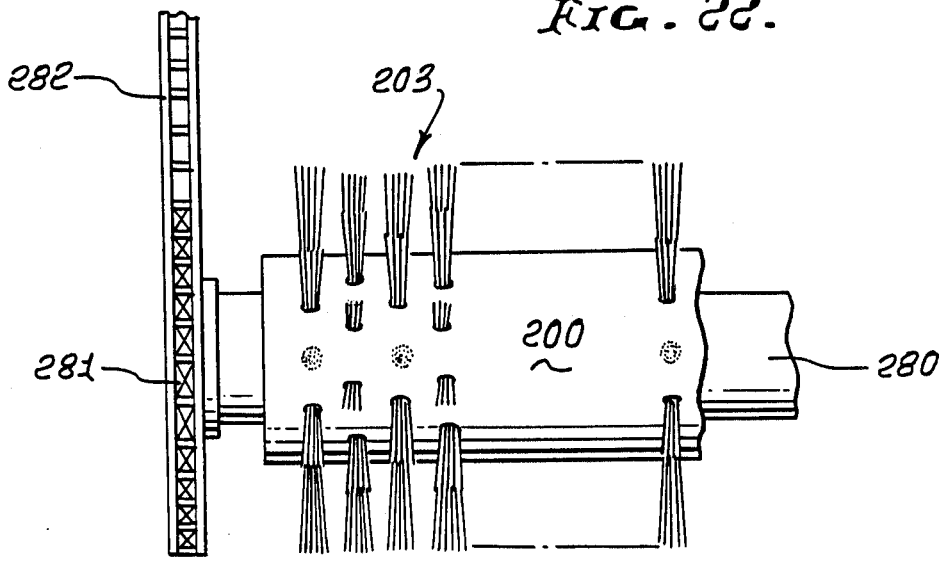
Figure 23:
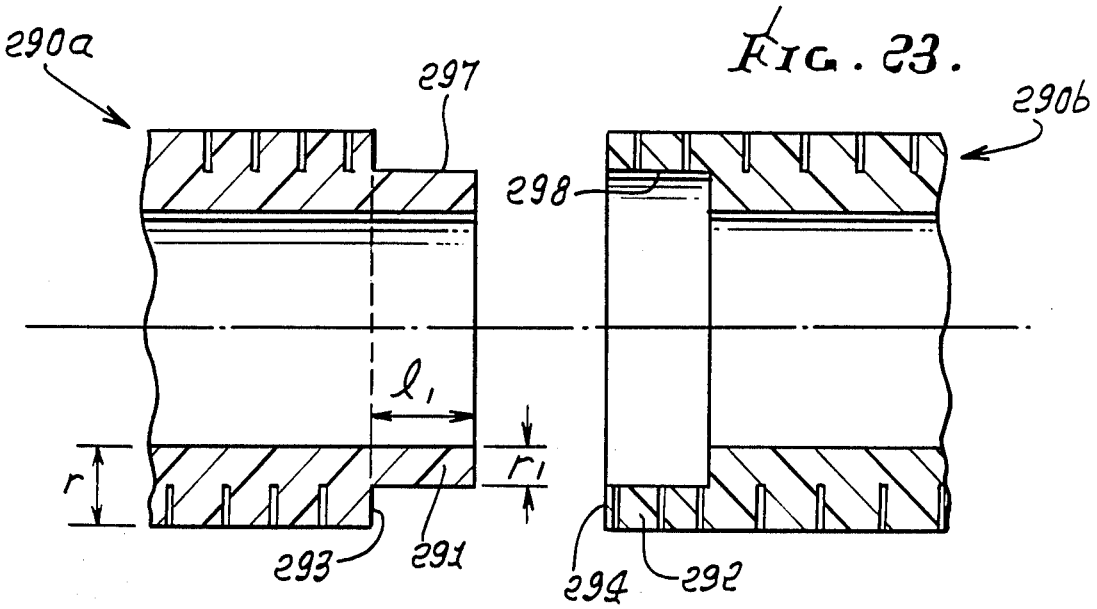
Figure 24:
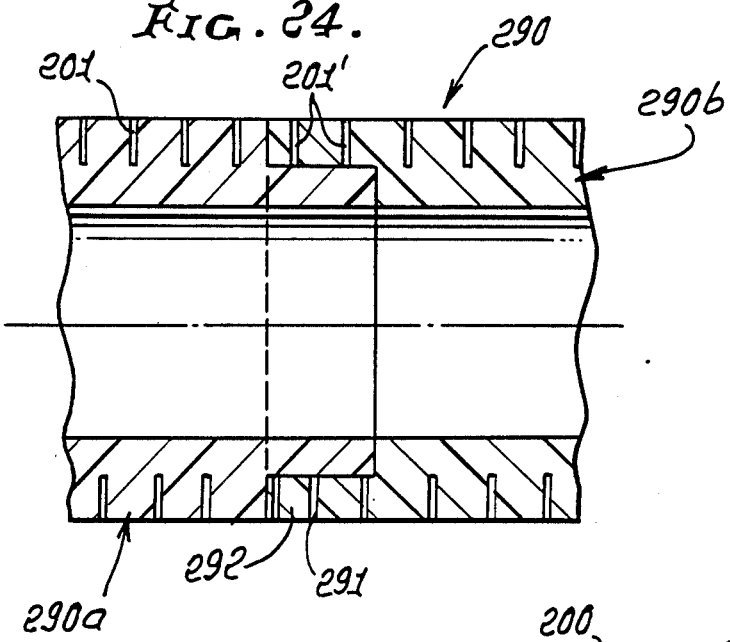
Figure 26:
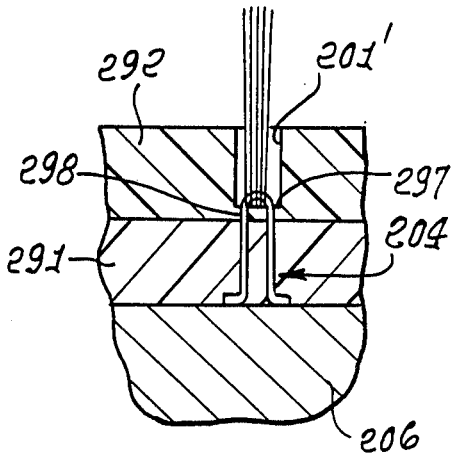
Figure 25:
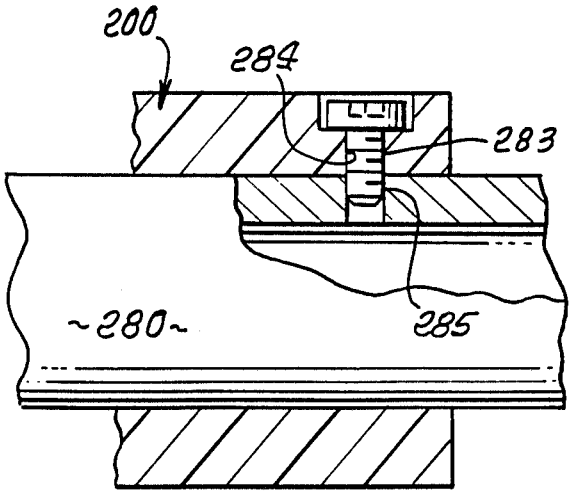
Figure 28:
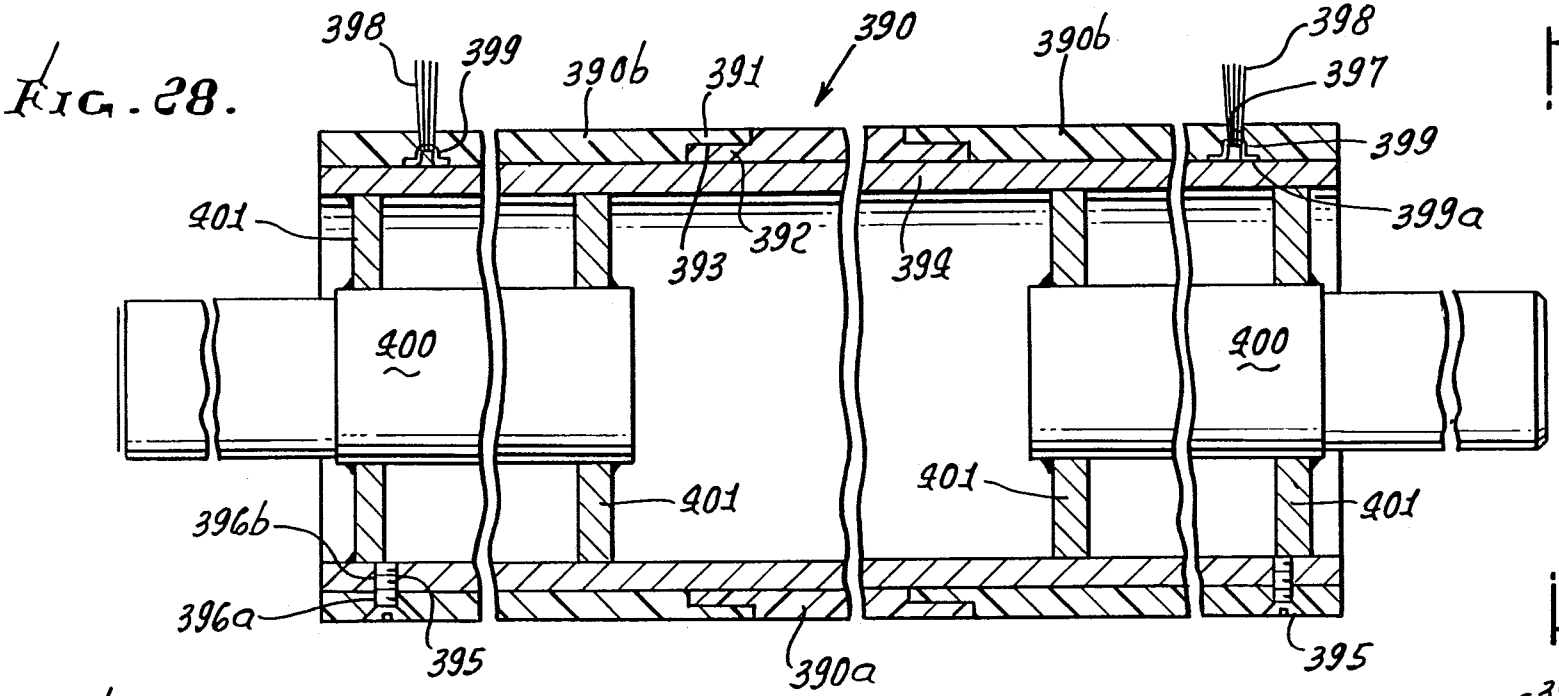
Figure 29:
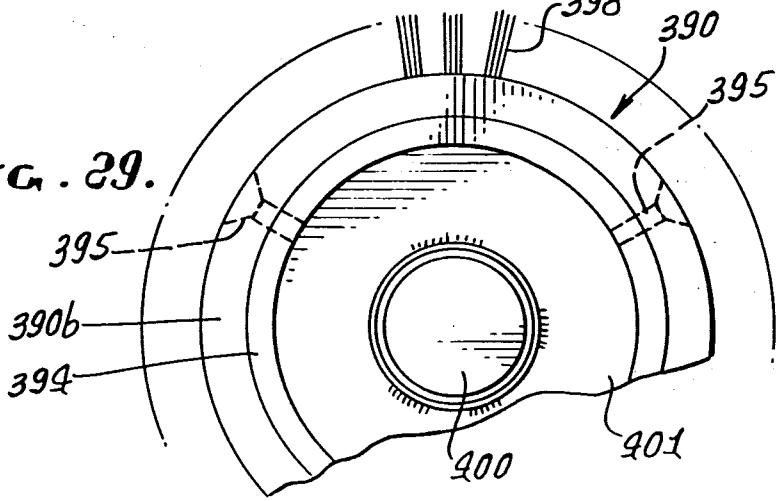
Figure 30:
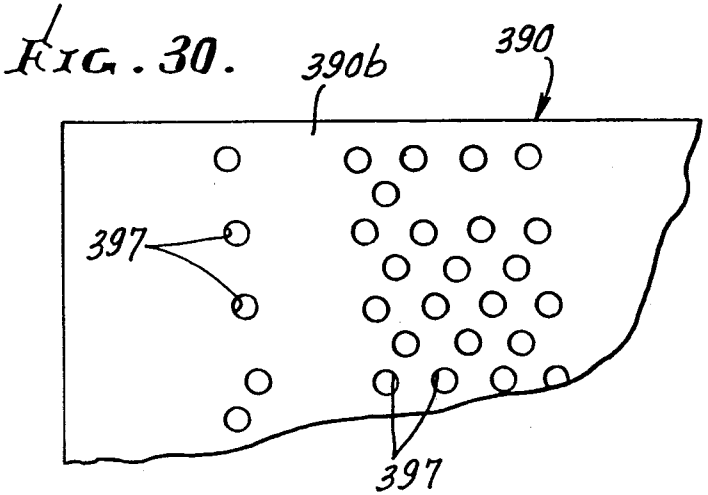
Figures 31, 32, 33, 34:
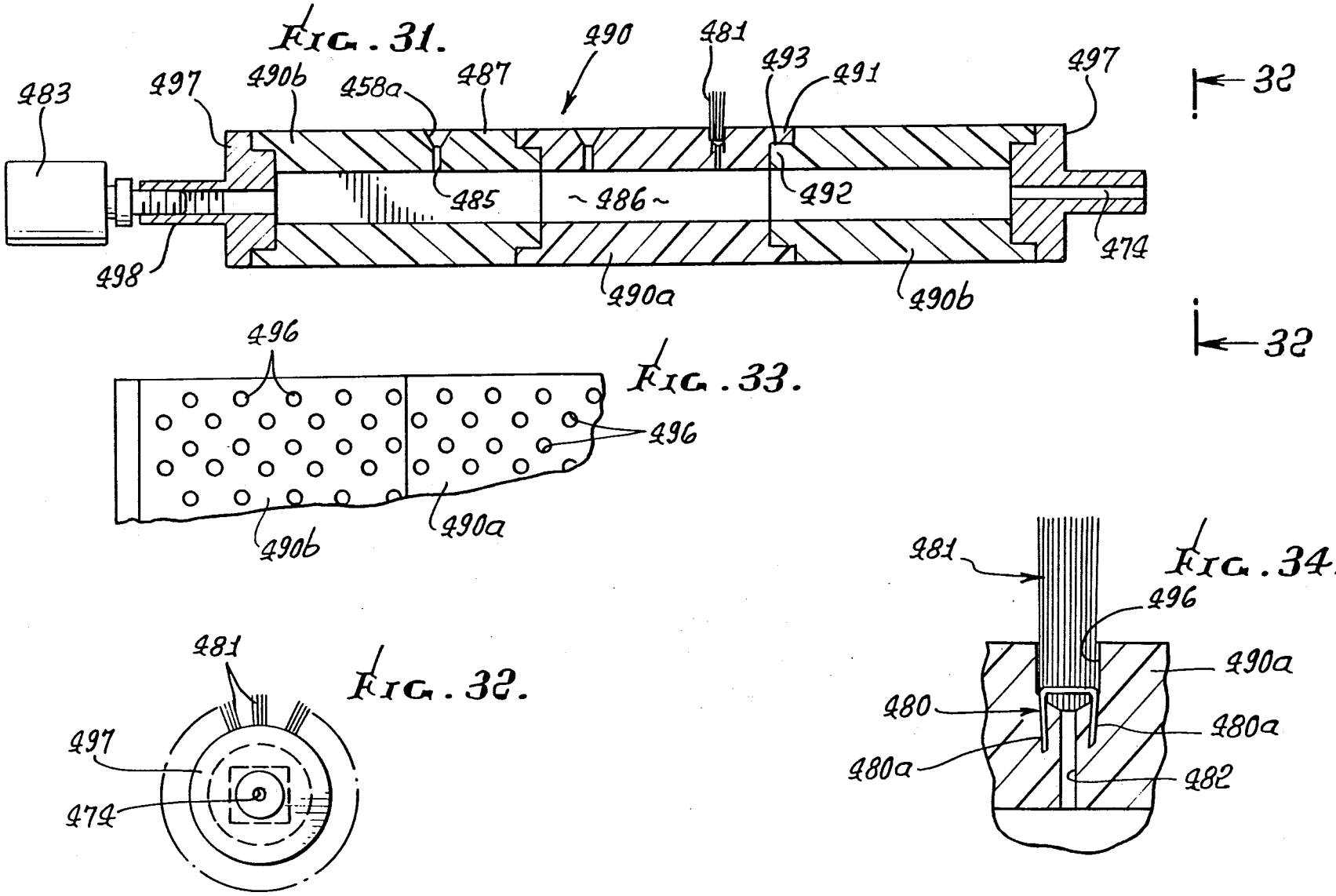
Figure 35:
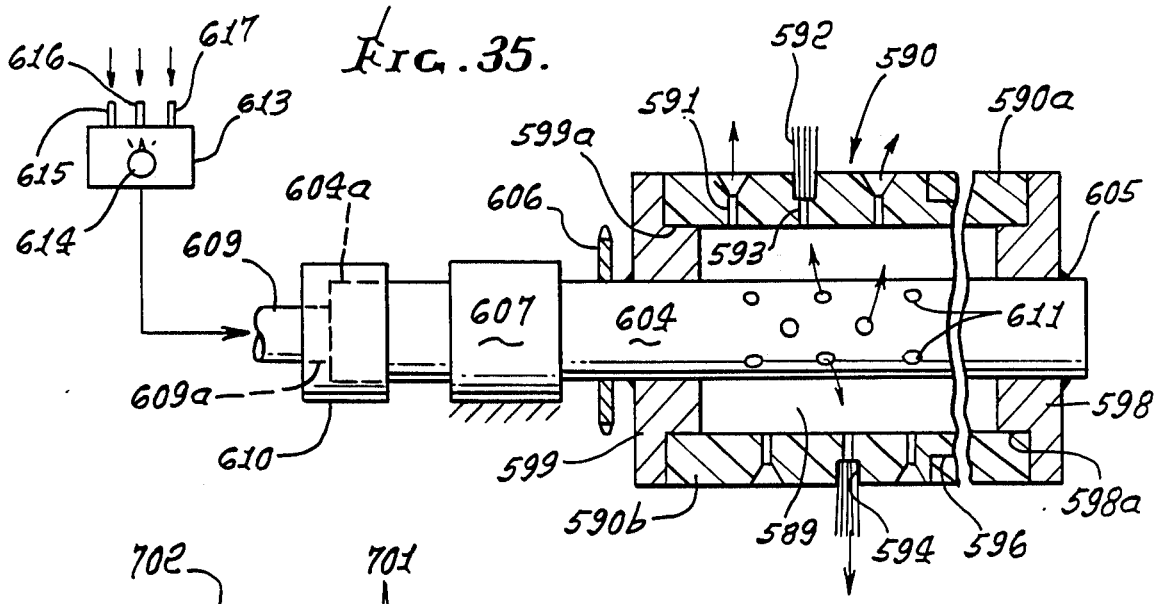
Figure 36:
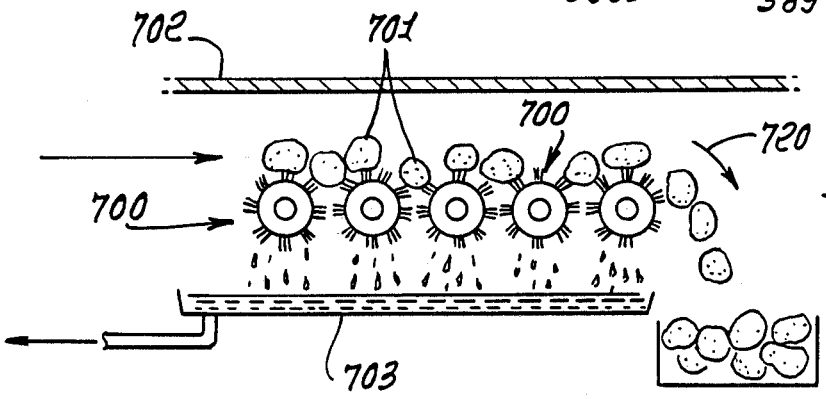
Figure 36A:
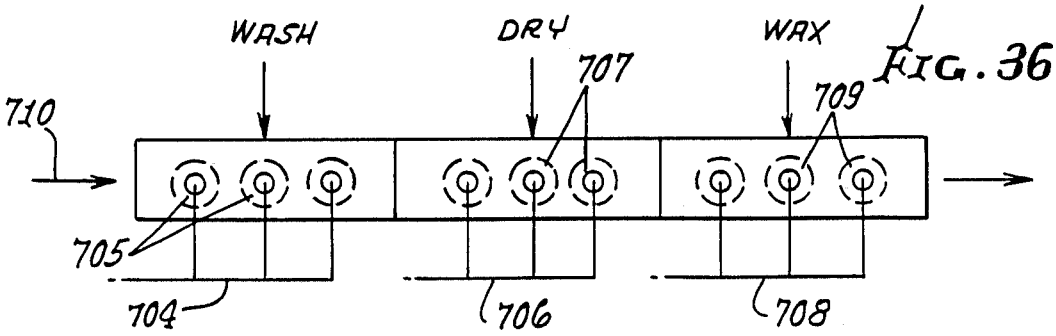

FIG. 21*a* is a section taken on lines 21*a*—21*a* of FIG. 21;

FIG. 22 is an elevation showing use of the completed brush, with the core sleeve mounted on a driven axle end;

FIG. 23 is a section showing core sleeve sections;

FIG. 24 is a view like FIG. 23, with the sections telescopically interfitted;

FIG. 25 is a section shows locking of a core sleeve to a driven axle rod;

FIG. 26 is an enlarged view like FIG. 21*a*, showing modification;

FIG. 27 is a view like FIG. 18, showing a modified brush;

FIG. 28 is a side elevation showing a modified form of a sectioned sleeve and drive;

FIG. 29 is an end view or lines 29—29 of FIG. 28;

FIG. 30 is a developed plan view showing drilled hole locations on the FIG. 28 sleeve;

FIG. 31 is a side elevation showing another modified form of sectioned core, and drive;

FIG. 32 is an end view on lines 32—32 of FIG. 31;

FIG. 33 is a developed plan view showing hole locations in the FIG. 31 core sleeve;

FIG. 34 is an enlarged fragmentary section showing details of bristle anchoring;

FIG. 35 is a side elevation, in section, showing fluid supply to a sectioned core;

FIG. 36 is a side elevation showing use of sectioned cores, with fluid supply, during washing of articles; and FIG. 36*a* is a side elevation showing a series of brushes which wash, dry, and wax articles.

Figure 37:
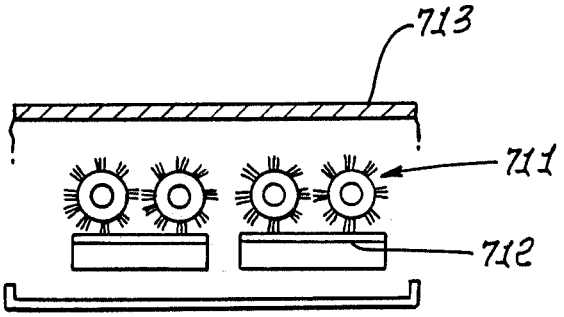

FIG. 37 is a side elevation showing use of sectioned cores, with fluid supply, during cleaning flat articles such as circuit boards.

DETAILED DESCRIPTION

Referring first to FIGS. 1*b*, 2*a*, 2*b*, 3–5, 8 and 13, the brush filling apparatus is seen to include a base 10 supported by legs 11, longitudinally spaced upright frames 12 and 13 carried by the base, and longitudinally spaced rotary heads 14 and 15 carried by the respective frames 12 and 13. The heads are horizontally axially spaced apart, and axially elongated supports in the form of rods interconnect the heads to rotate therewith. For example, three such rods 16 may be spaced at equal intervals about the head axis 17 of rotation, as is clear from FIG. 8. Accordingly, as head 15 is rotated about axis 17, it transmits such rotation to the head 14, via such rods. An auxiliary and axially adjustable head 15*a* is carried on the rods between heads 14 and 15 to rotate therewith, for purposes as will appear.

First means is provided to releasably couple three longitudinally spaced brush cores 18, 19 and 20 to the heads, as for example to heads 14 and 15*a*, with the cores spaced about axis 17. Such means is indicated generally at 21 in FIG. 6 for coupling the left ends of the cores to the head 14, and at 22 in FIG. 14 for coupling the right ends of the cores to auxiliary head 15*a*. The cores are typically spaced at equal angular intervals between the rods 16, as is clear from FIG. 8.

Figure 8:
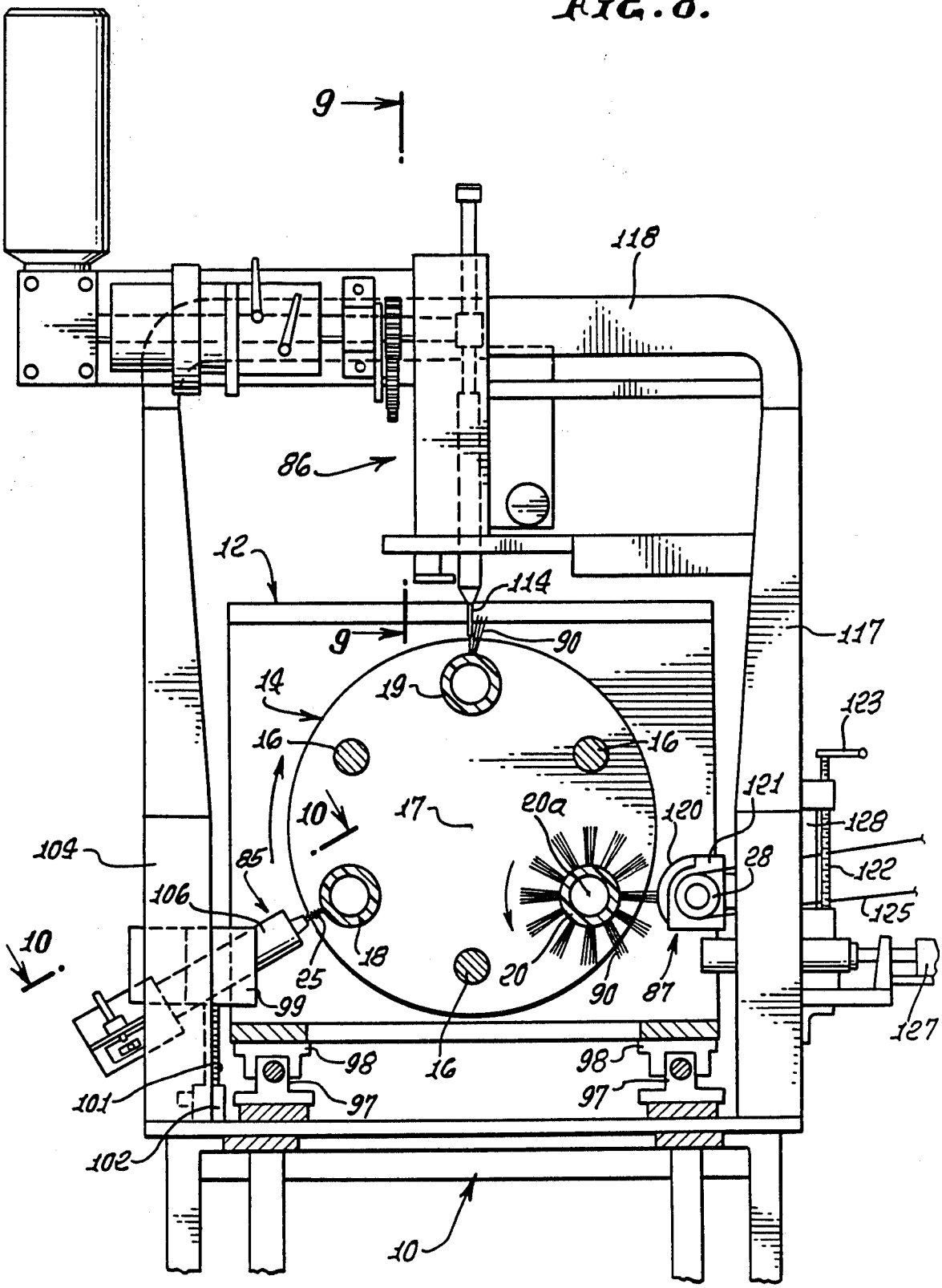
FIG. 8 is an enlarged sectional elevation taken on lines 8—8 of FIG. 1*a;*

Second means is provided to rotate at least one of the heads about the central axis 17, thereby to rotate the other heads, the rods and the cores between three index positions. Such positions are shown in FIG. 8 as a first index position at which holes are drilled in the core at that position, as by third means including drill 25 directed toward the side of th core 18, the drill driven by a motor 26; a second index position at which bristles 90 are filled into the drilled holes, as by fourth means 86 including fill tip 114; and a third index position at which filled-in bristles 90 projecting from the core are trimmed, as by fifth means 87 including rotary cutter 120 and rotary drive 28 therefor. Also, core 20 may be independently rotated, about its axis 20*a* during the trimming operation, while heads 14, 15 and 15*a* are not rotated, so that all projecting bristles are trimmed to the same length. Such trimming may be effected while holes are being drilled in core 18, and bristles are being filled into the holes in core 19. Thus, these operations are carried out, and on successive cores, each time the heads are rotated to a "next" index position; and before each such rotation, the filled and trimmed core at position 20 is removed, and a new core inserted, so that upon rotary indexing, the new core will be carried to position 18 for drilling.

SPECIFIC DESCRIPTION

Figure 6:
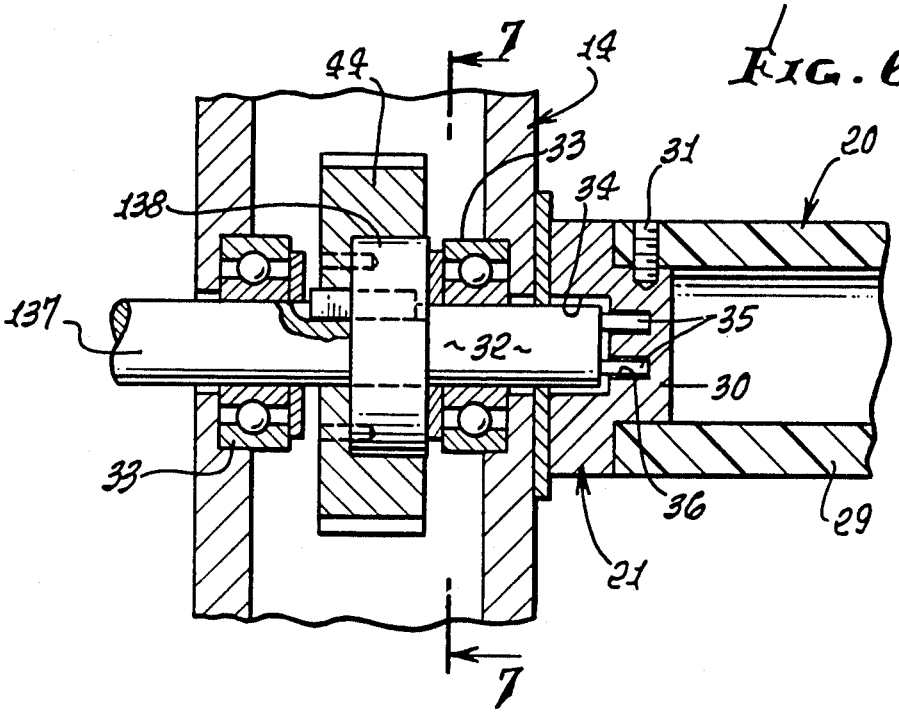
FIG. 6 is an enlarged section taken in elevation on lines 6—6 of FIG. 5.

Referring to FIG. 6, each core 18–20, is shown to include a cylindrical body 29, having a plug 30 temporarily retained to one (left) end of the body as by a set screw 31. Plug 30 is coupled to the head via a rotary shaft 32 supported by the rotary head 14, as via bearings 33. The rightward end of the shaft penetrates a recess 34 in the plug, and pins 35 protrude from the end of the shaft into drilled openrngs 36 in the plug. Accordingly, as the head 14 rotates about axis 17, the core is also rotated about that axis; and as the shaft 32 is independently rotated at an index position (see FIG. 8) the core is rotated. See for example the drive mechanism 37 in FIGS. 3–6, including drive motor 38 having output shaft 39, the latter coupled at 40 to shaft 41 extending to head 14; spur gear 42 on shaft 41, in head 14; and spur gear 43 in the head meshing with gears 42 and with driven gears 44 on shafts 32. Gears 43 are carried by shafts 46 in the head. Motor 38 is carried by a block or support member 47 mounted on a jack screw mechanism 48 by the frame 12; thus, block 47 has threaded connection with vertical screw 50, the head 14 also carried by that block. Screw 50 is rotatable by a nut 51 and gear box 52, both carried by frame 12. Accordingly, the cores 18–20 can be lifted and lowered, at their left ends, and relative to the mechanism for filling bristles into the uppermost core 19 in FIG. 8, whereby bristles of selected length can be filled into the core.

Figure 1A:
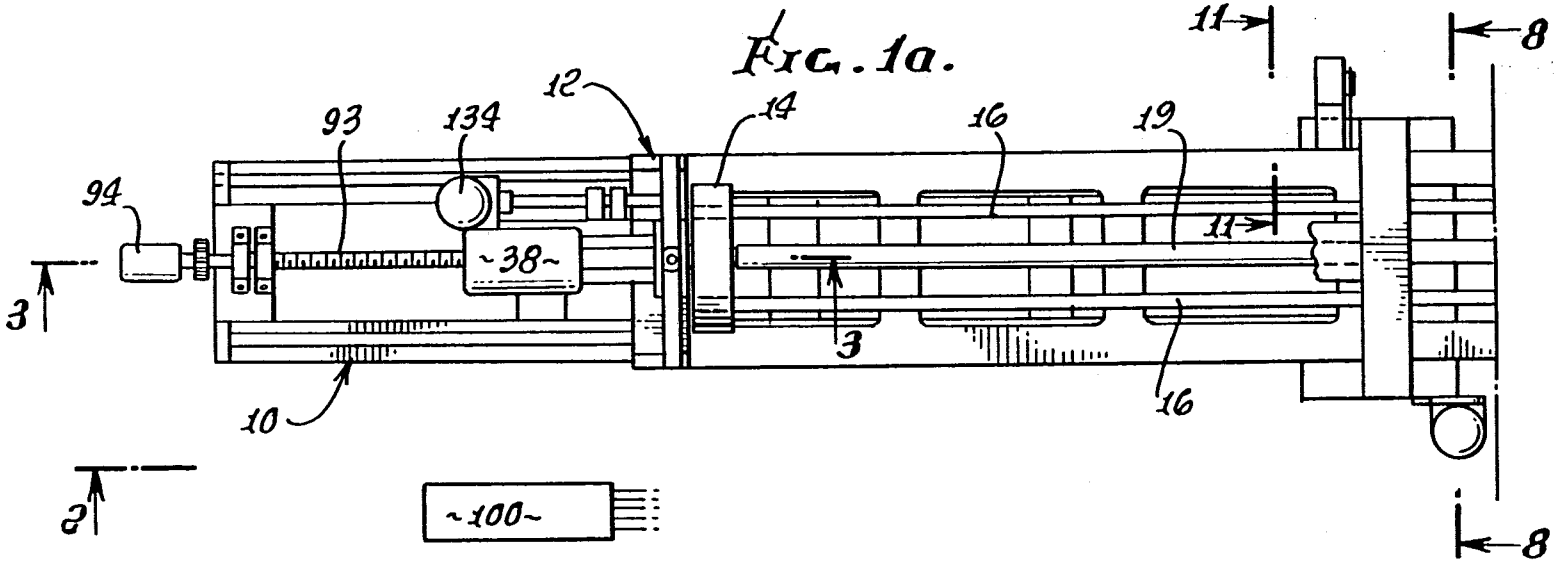
Figure 1B:
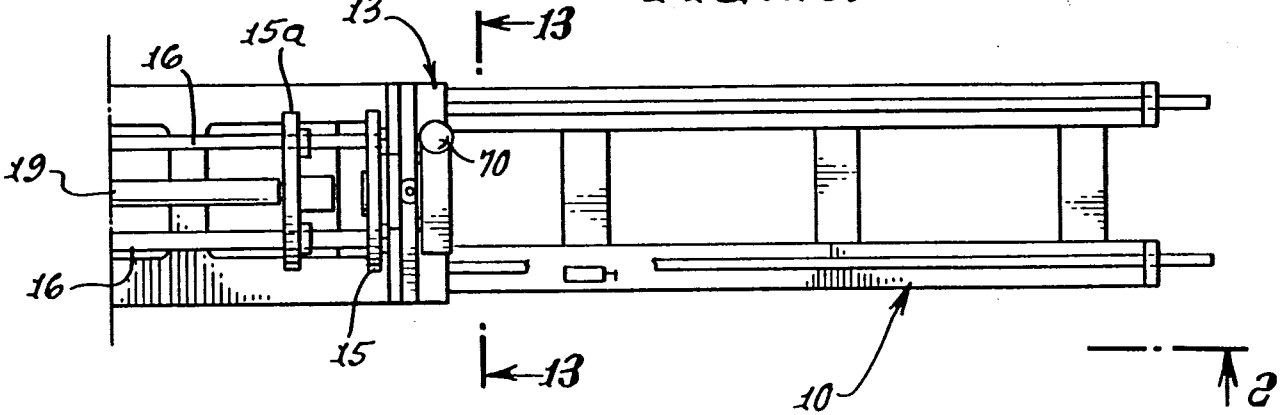
Figure 2A:
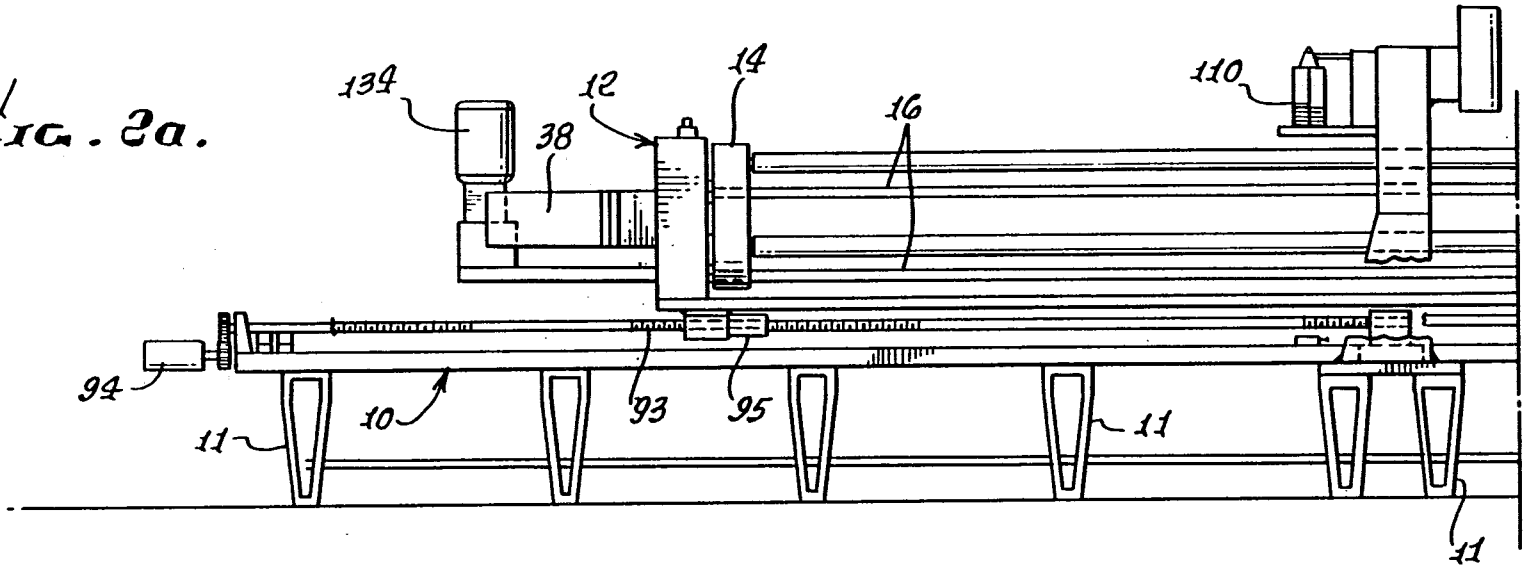
Figure 2B:
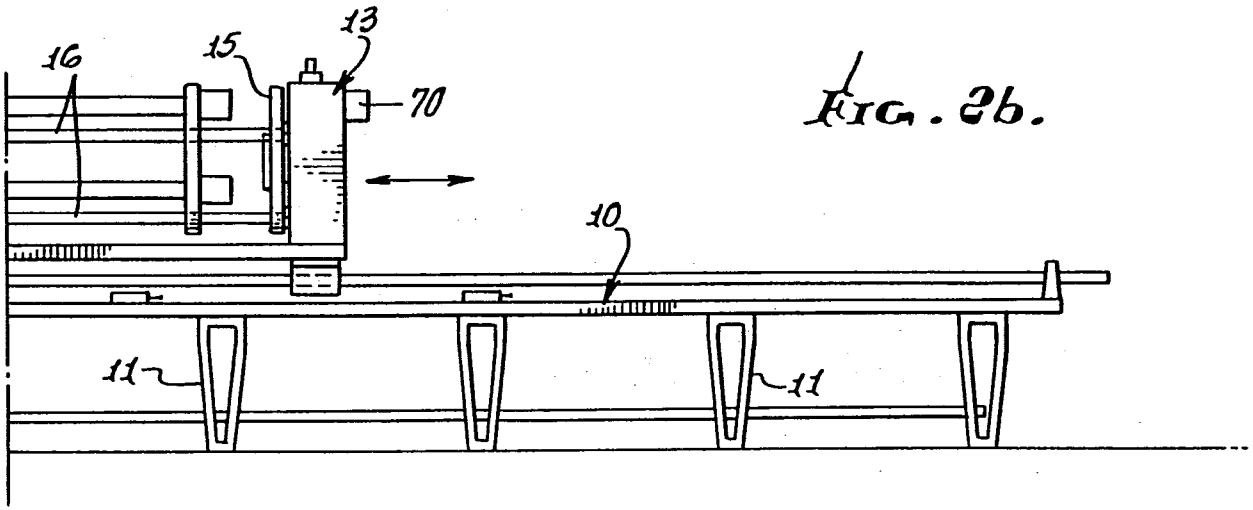
Figure 3:
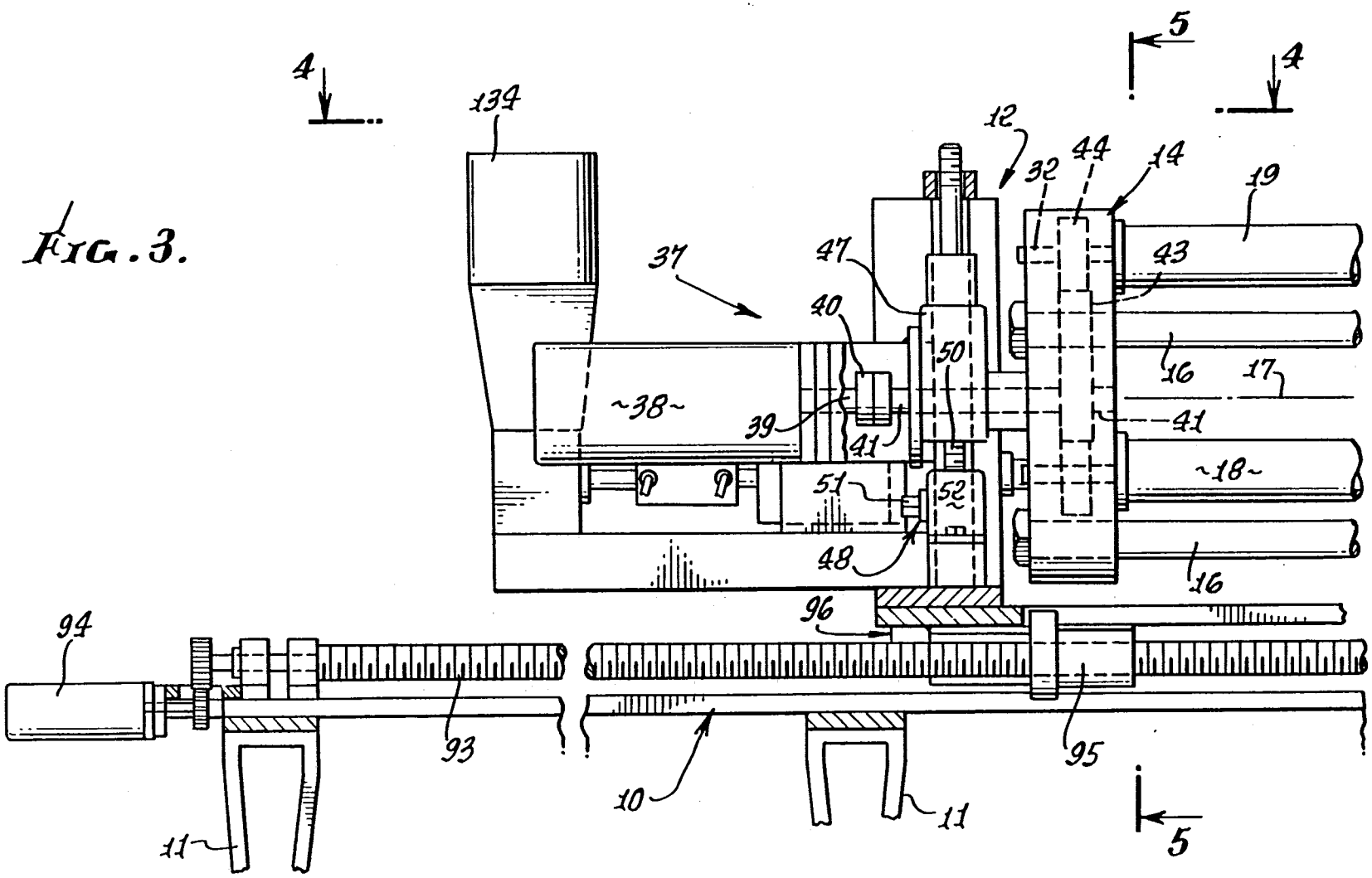
FIG. 3 is an enlarged fragmentary elevation taken in section lines 3—3 of FIG. 1*a;*
Figure 15:
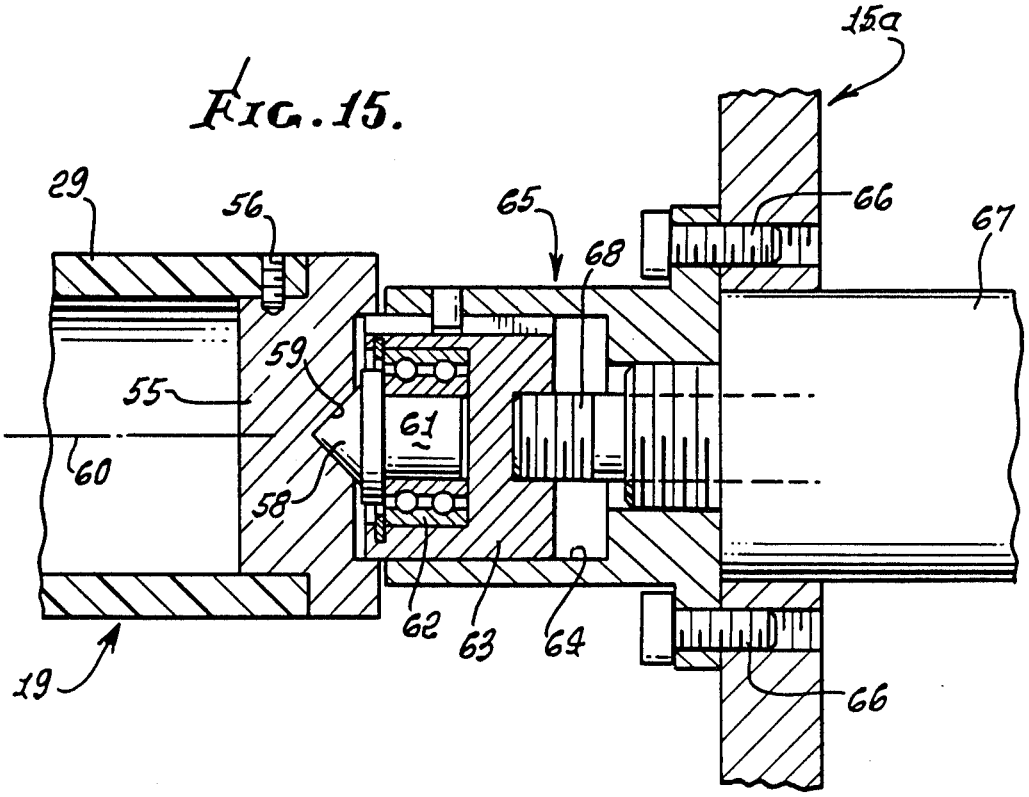
FIG. 15 is an enlarged plan view taken in section on lines 15—15 of FIG. 14.
Figure 14:
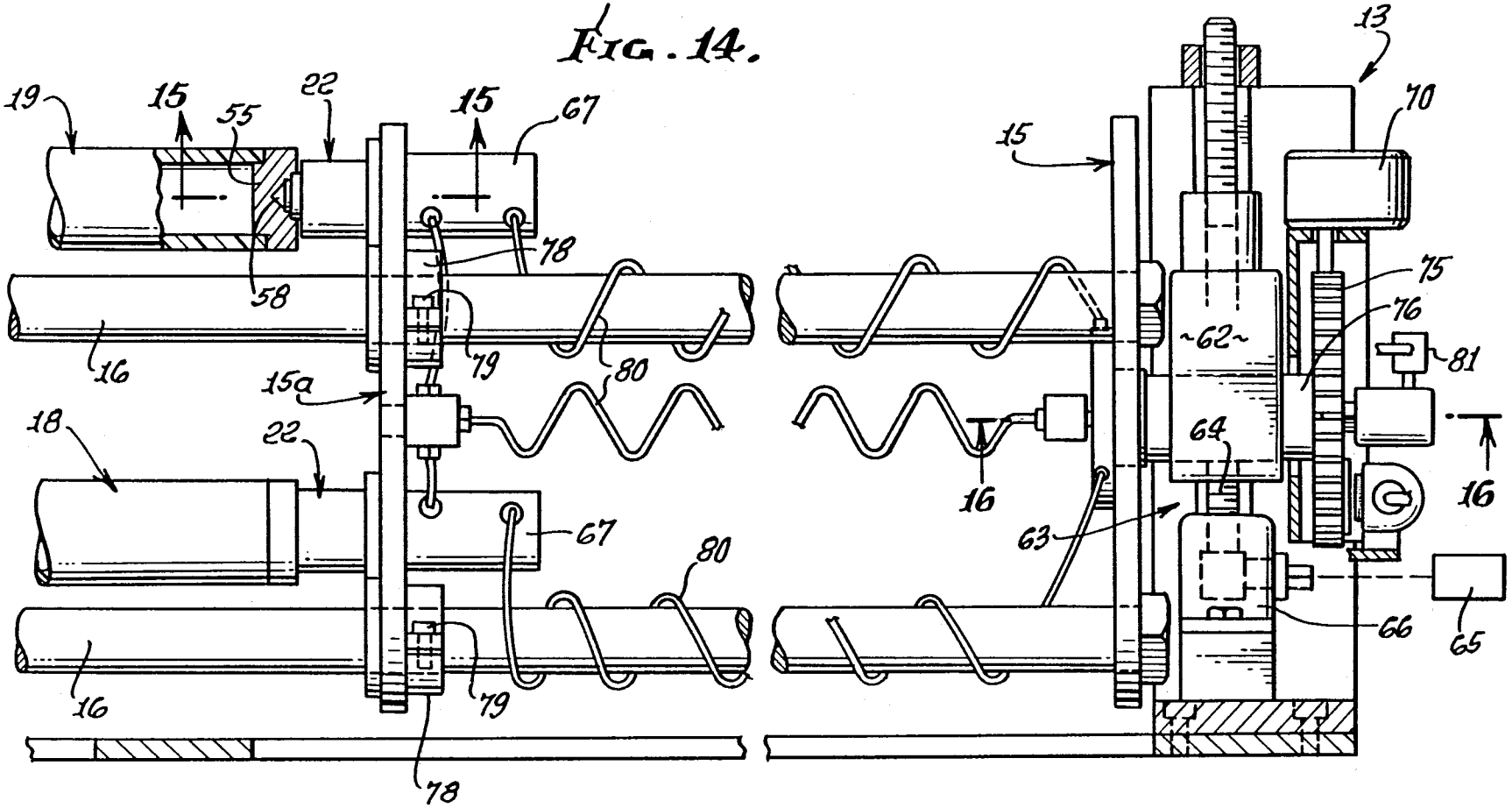
FIG. 14 is an enlarged fragmentary side elevation taken on lines 14—14 of FIG. 13.

Referring to FIGS. 14 and 15, each core body 29 has a plug 55 temporarily to the other (right) end of the body, as by a set screw 56. Plug 55 is coupled to the rotary head 15*a* to allow core rotation relative to that head (as described above) and for rotation with that head, via rotary drive transmitted as by rods 16, explained above. For this purpose a conical insert 58 is removably receivable into a conical recess 59 located in the plug 55, in alignment with the core axis 60. Insert 58 is carried by a shaft 61 rotatably mounted as by bearings 62 carried by an axially shiftable plug 63. The latter is shiftable axially in the bore 64 of a carrier 65 attached to head 15*a*, as by fasteners 66. An actuator 67 also carried by the head has a shaft 68 connected to plug 63, to controllably shift it leftwardly. When core connection to head 15*a* is desired, its left end is first releasably connected to head 14 as described above. The rightward end of the core is then aligned with tapered insert 58 which is retracted (rightward) position. The actuator is then operated to insert the plug into tapered recess 59. A master control 100, such as may include a programmable computer, (see FIG. 1*a*) has controls to operate the motors and actuators described herein, as by appropriate connections therewith.

Figure 13:
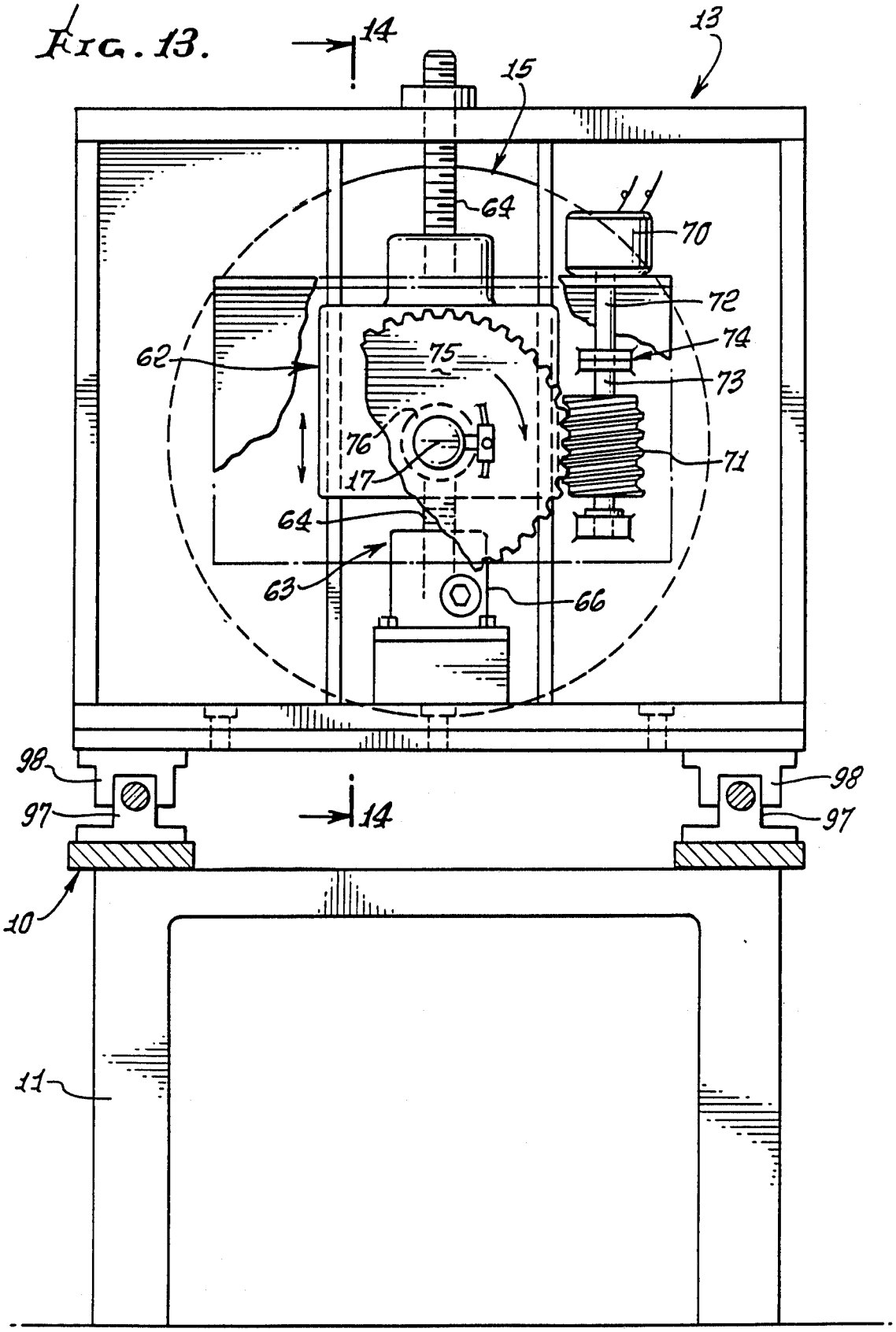
FIG. 13 is an enlarged vertical section taken on lines 13—13 of FIG. 1*b;*

Lifting and lowering (lateral displacement) of the rightward ends of the cores 18–20 is achieved via the head 15*a*, the rods 16 that support that head, and the head 15 to which the rods are connected, as shown in FIGS. 13 and 14. Head 15 is carried by a block (support member) 62 mounted on a jack screw mechanism 63; thus, block 62 has threaded connection with vertical screw 64. The latter is rotatable by a drive including motor 65 and gear box 66, both carried by frame 13. Accordingly, the cores 18–20 can be lifted and lowered, at their right ends, and in synchronism with their left ends (through master control 100) and relative to the mechanism for filling bristles into the uppermost core 19, for purposes referred to, and to be later described.

Means is also provided to rotate at least one of the heads about their common axis 17, so as to achieve core rotation between and into three index positions, as shown in FIG. 8. FIG. 13, shows one such means to include a step motor 70, a worm 71 coupled to step motor 70 by shafts 72, 73 and coupling 74; a large diameter spur gear 75 coupled to the worm, to be controllably driven about axis 17; and a shaft 76 interconnecting gear 75 and head 15 to rotate the latter aboutaxis 17. Shaft 17 is carried by block 62, as shown in FIG. 14.

Longer cores 18–20 can be accomodated between heads 14 and 15*a* by moving head 15*a* rightwardly on rods 16, in FIG. 14, and shorter cores can be accomodated by moving head 15*a* leftwardly on the ends. At selected positions, the head 15*a* can be attached to the rods, as by means of a clamp 78, integral with the head 15*a*, and through which a rod 16 passes. A fastener 79 is tightenable to lock the clamp to the rod. The actuators 67 are also shown in FIG. 14 as pneumatically operated, with air pressure lines 80 extending about the rods to accomodate head 15*a* movement on the ends, left or right. A single source 81 of air pressure supplies all the lines 80, and is valve controlled, via master control 100.

BRISTLE FILLING AND TRIMMING

Referring now to FIG. 8, the following are generally indicated:

third means, as at 85 for example, to drill bristle receiving holes in a core 18 at one of the core rotary index positions, as shown;

fourth means, as at 86 for example, to fill an affix bristles 90 into such drilled holes in core 19 at another of the core rotary index positions; and fifth means as at 87 for example, to trim bristles 90 that project outwardly from holes into which the bristles have been affixed, in core 20, at a third of the core rotary index positions. As explained above, after bristle trimming, the core 20 is removed from the apparatus, and a new and undrilled core is inserted into position 20, for subsequen indexing to station positions indicated by cores 18 and 19.

Figure 10:
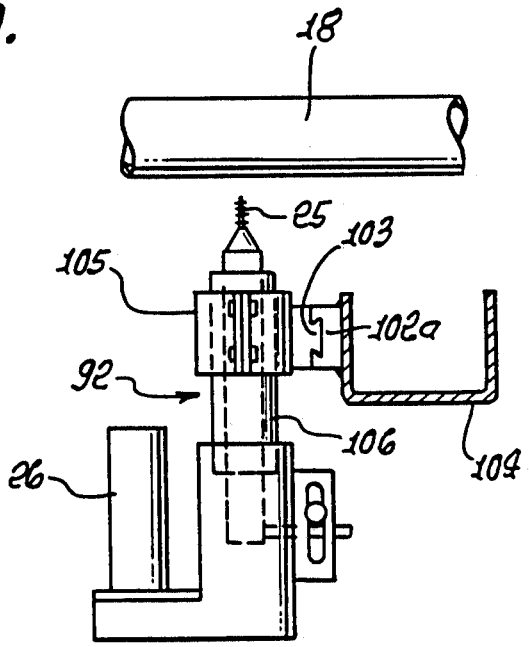
FIG. 10 is an enlarged section taken on lines 10—10 of FIG. 8.

As shown in FIGS. 8 and 10, a drill 25 is rotated by a motor 92, and also suitably advanced and retracted as by actuator 106 generally radially relative to a core 18, to drill a hole in core 18. Multiple holes are drilled at circumferential and axial intervals, due to controlled rotation of the core (as by gearing shown in FIG. 5) and controlled axial movement of the core, relative to the drill. Such axial movement is effected as by rotation of a lead screw 93 by servo motor 94, indicated for example in FIG. 3. As screw 93 rotates, it progressively axially displaces a nut 95 to which frame 12 is connected at 96. See also FIG. 5. Frame 12 is supported on rails 97 extending axially on base 10, as via slippers 98 attached to the frame 12. Frame 13 is similarly supported on rails 97, to slide axially along in response to frame 12 axial movement, due to rod 16 interconnection of the frames 12 and 13. Thus, the cores 18–20 are accurately movable axially relative to the third, fourth and fifth means, and to enable drilling of holes as in core 18 at accurately spaced axial intervals, and to enable positioning of the holes in alignment with the bristle filling means 86.

The drill actuator and motor unit 92 is supported by a nut 99 on vertical jack screw shaft 101 rotated by manual adjustment or motor 102. This enables the drill to remain in radial alignment with core 18, despite lifting and lowering of the frames and heads, as previously described. See also guiding and relatively slidable tongue and groove parts 102*a* and 103, part 102*a*, on frame member 104, and part 103 on a clamp 105 attached to the actuator housing 106.

Figure 9:
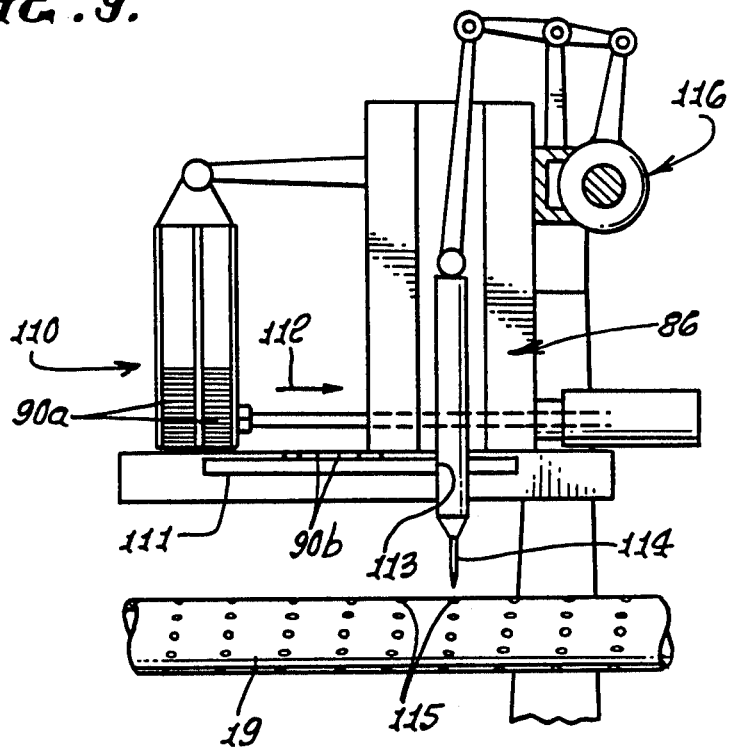
FIG. 9 is an enlarged sectional elevation taken on lines 9—9 of FIG. 8.

The bristle fill means 86 is shown in FIGS. 8 and 9 as including a bristle feeder 110 from which stacked bristles 90*a* are fed onto a tray 111. They are then suitably advanced rightwardly (see arrow 112, and bristles 90*b*) until they overlap an opening 113 in the tray. A vertically operable plunger 114 displaces groups of bristles downwardly, in V-shape, into a pre-drilled hole 115 in the core 19, and affixes them as for example via a staple fed to the tip of the plunger. Other affixing means may be employed. Mechanism to move the plunger up and down is indicated generally at 116. Bristle feeding and filling apparatus of the generally type is known, as for example is described in U.S. Pat. No. 2,689,152. Arbor structure including frame parts 104 and 117, and cross piece 118, support the mechanism 86.

Figure 11:
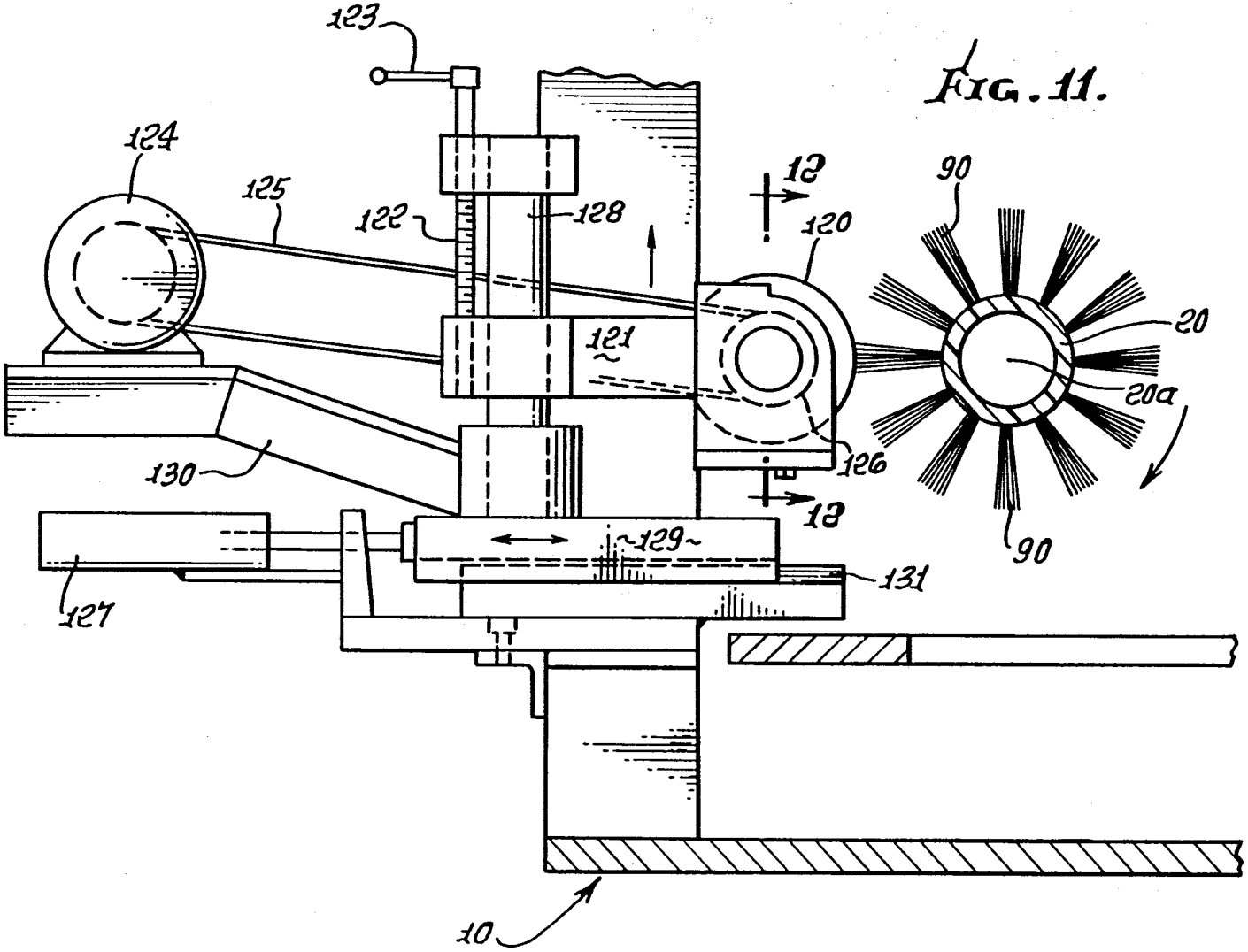
FIG. 11 is an enlarged section taken in elevation on lines 11—11 of FIG. 1*a;*
Figure 12:
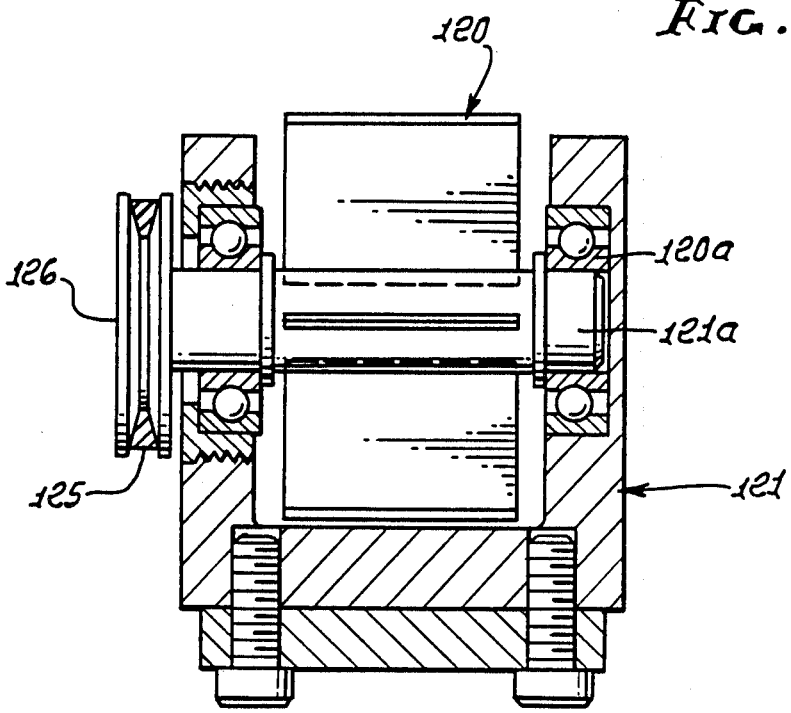
FIG. 12 is an enlarged fragmentary section taken on lines 12—12 of FIG. 11.

The bristle trimming means 87 is shown in FIGS. 8 and 11 to include a rotary cutter 120, supported for rotation on bracket 121. The latter may be moved up and down by rotation of a lead screw 122, as by handle 123, the screw carried by post 128 which also carries bracket 121. A motor 124 drives the cutter as by a belt 125 entrained on a hub 126 associated with the cutter. In addition, the cutter may be moved toward and away from the bristles, as by an actuator 127 connected with a support 129 for the post 128 and motor carriage 130. A guideway 131 guides in and out movement of the support 129. Accordingly, bristles may be trimmed to selected length, and up and down movement of the heads and frames is enabled. See also cutter shaft 121*a* bearing supported at 120*a*.

Figure 4:
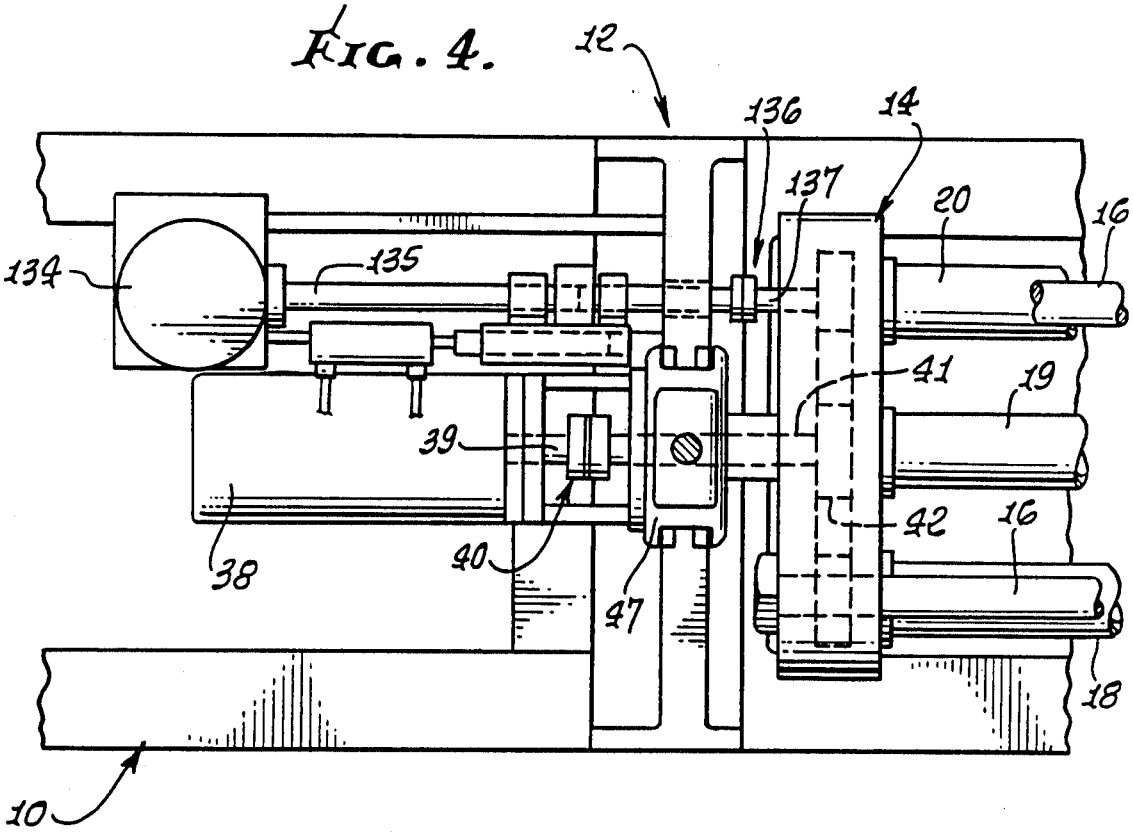
FIG. 4 is an enlarged fragmentary plan view taken on lines 4—4 of FIG. 3.

Referring back to FIGS. 5–7, indexing rotation of the cores 18–20 is provided for by the above described gearing, servo motor 38 providing such indexing input, whereby accurate rotary location of the holes and bristles feed to the holes is achieved. In addition, core 20 may be independently rapidly and continuously rotated, so that bristles may be trimmed, as described. Means to rotate the core 20 is shown in FIG. 4 to include a drive motor 134, drive shaft 135, releasable external coupling 136, drive shaft 137, and clutch 138 connectible to core rotating shaft 32 via a clutch 138 (three such clutches are provided, on for each shaft 32). When coupling 136 is made up, after rotary indexing of the cores and rods and heads to a position as shown in FIG. 8, rapid and continuous rotary drive is transmitted from motor 134 through coupling 136 and override clutch 138 to shaft 32 and core 20 in trim position. Such rotation is transmitted in direction 140, in FIG. 7, overriding the coupling of gear 44 to the shaft 32. When drive is transmitted from gear 44 to shaft 32 in position 18 and 19 of the cores (9n FIG. 8) the clutch parts (see ball 142 and dog 143) transmit such torque to the shaft 32, in rotary direction 144.

Figure 16:
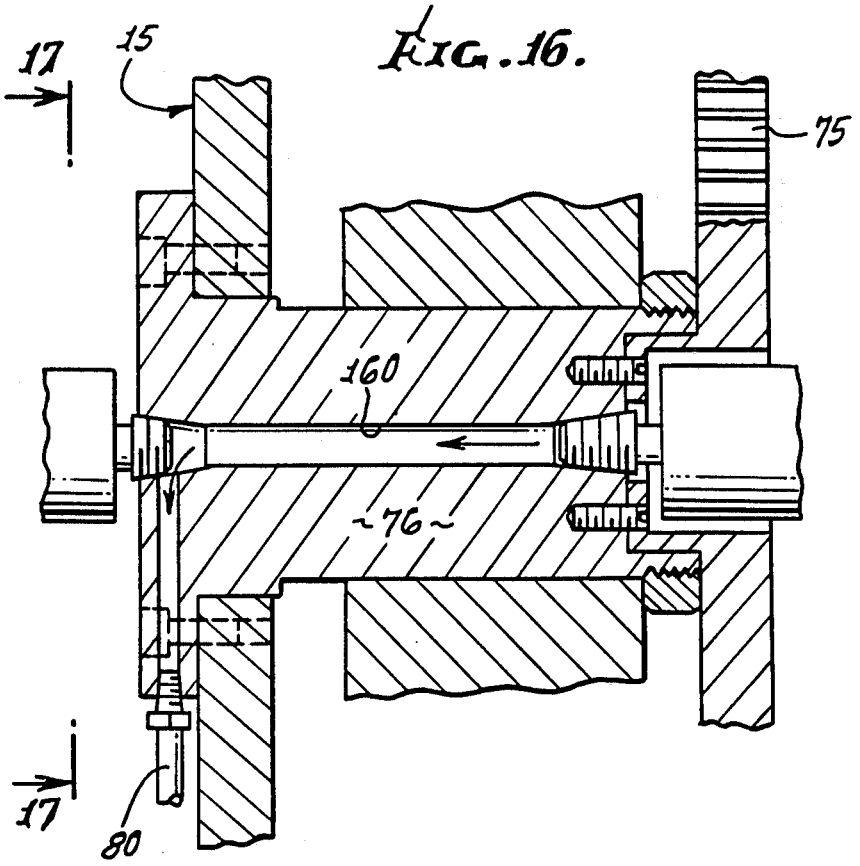
FIG. 16 is an enlarged plan view taken in section on lines 16—16 of FIG. 14.
Figure 17:
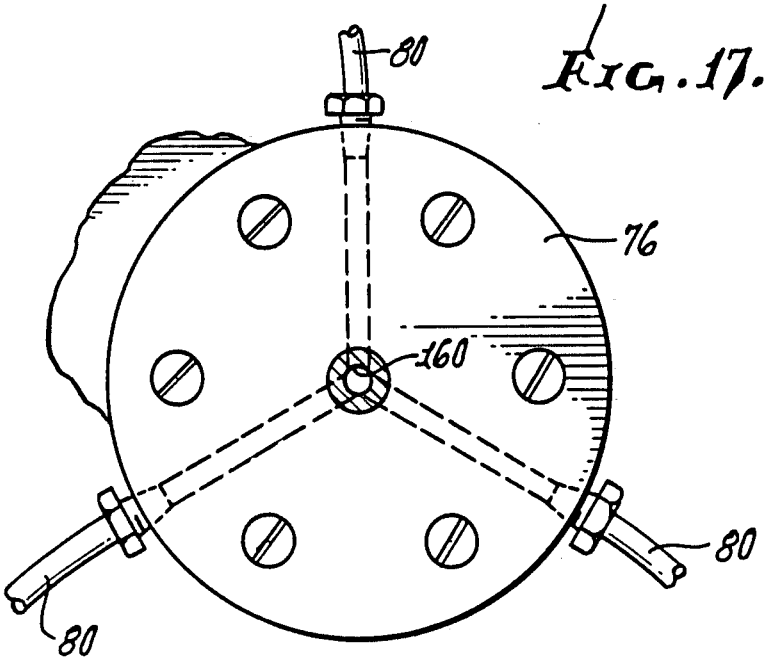
FIG. 17 is an enlarged side elevation taken on line 17—17 of FIG. 16.

FIGS. 16 and 17 show pneumatic air pressure supply to lines 80 via porting 160 in shaft 76.

Figure 19:
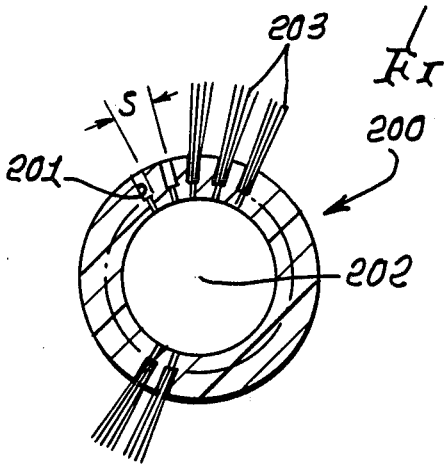
FIG. 19 is a section on lines 19—19 of FIG. 18.
Figure 20:
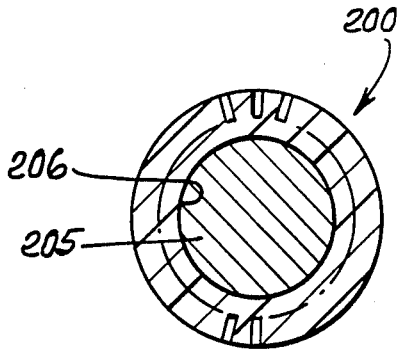
FIG. 20 is a section like FIG. 19, showing a mandrel inserted into the plastic core sleeve.

FIGS. 18–20 illustrate a brush core 200 to be filled with bristles, by the process of operation of the FIGS. 1–17 apparatus, for example. The core is cylindrical and axially elongated, and typically consists of tough, durable, synthetic resin. One example is ABS.

Holes 201 are formed in the core, as by drilling employing the above described process. The holes extend from the core outer surface in an inward direction, to form a pre-selected pattern about and along the core, as controlled by the computer 100. For example, the holes may extend in a spiral pattern about the core axis 202 and lengthwise of the core as well as at equal spacing "s". The process enables very accurate selection or control of such spacing "s", as well as of the angle "$\alpha$" of the spiral, to provide brushes with a very wide range of such dimensions. Bristles are shown filled into the core, at 203; and densely filled brushes may be so produced with at least about 25 spiral convolutions of holes (and bristles) per axial foot along the core length. The cores of such brushes may range from $1\frac{1}{2}$ to 4 inches in diameter, for example.

FIG. 20 shows core 200 into which a metallic shaft or mandrel extends axially, for support, and also for deflecting the staple ends. The shaft is shown in the form of steel rod 205 engaging and supporting the bore 206 of the plastic core, whereby much longer length cores and brushes are made feasible, without undesirable bending.

FIG. 21 shows a bristle group 203 filled into a hole, 201 with a retainer, such as a staple 204, holding or anchoring the bristles in position. For this purpose, the bristles may have U-shaped portions 203*a* at the bottom of the hole. The staple 204 has a cross-piece 204*a* extending over the bristle U-shaped bristle portion 203*a;* and the staple has stems or legs 204*b* penetrating downwardly into the core material. The end portions 204*c* of the stem or Legs of the staples (typically metallic) are deflected laterally by mandrel 205 to extend generally tangentially to the sleeve bore, and within the sleeve material, to anchor the staples to the sleeve. Note that the depths "d" of the holes 201 are about half the radial thickness "r" of the sleeve. The process of filling the bristles into the holes and anchoring them proceeds in accordance with the description of FIG. 1–17. Staple inserters or pushers appear at 310.

Following completed filling of the core sleeve, and bristle trimming, it is removed from the mandrel and typically shipped to a customer as a replacement. The sleeve is then mounted by the customer upon a drive shaft or axle 280 of equipment utilizing the brush, and suitably driven in rotation. See for example sprocket and chain drive elements 281 and 282, shown in FIG. 22. Thus, a customer need not ship a heavy metallic core to the brush filler, for bristle filling and return; he need only order a lightweight replacement core sleeve in which bristles have been filled, and mount it on his equipment, for use, as described. FIG. 25 shows attachment of the core sleeve to a drive shaft 280, as by a bolt 283 placed into a drilled hole 284 in the sleeve, and threadably connected at 285 to the axle 280.

Referring now to FIGS. 23 and 24, the illustrated modified sleeve comprises multiple sleeve sections extending coaxially and having end extents in mutually telescoping relation. Accordingly, a selected number of such sections may be interfitted to make up a complete core sleeve of selected length, thereby to match the. customer's brush length requirements. As shown, two sections 290*a* and 290*b* of a desired overall length core sleeve 290 have telescopically interfitting capability. Thus, one section 290*a* has an inner cylindrical extent 291 of reduced radial thickness "$r_1$", and length $l_1$; and the second section 290*b* has an outer cylindrical end extent 292. When interfitted, end walls 293 and 294 extend in close, or engaged, relation, and end walls 295 and 296 extend in close, or engaged, relation, and outer surface 297 may frictionally engage bore 298. Thickness $r_1$ is about half the total radial thickness r of each section.

Each section may be separately mounted on the equipment described above in FIGS. 1–7, and holes 201 drilled in the manner previously described, excepting that no holes are drilled in end extent 291, as is clear from FIG. 23. Thereafter, when the sections 290*a* and 290*b* are interfitted as shown in FIG. 24, there is spiral hole continuity across the telescopic interfit, i.e. from one section to the next.

Staples 204 are then driven into the core sections during bristle filling, to anchor the bristles in position as described above. Since no holes were drilled in end extent 291, the staples penetrate same from holes 201' directly thereabove, to anchor the bristles, and the staple ends are deflected as by mandrel 206, illustrated in FIG. 26, and also as described above. In addition, the staples extending in holes 201' and into section 291 anchor the latter to section 292. In this regard, the bottoms 297 of the holes 201' may be spaced from section 291 to provide some material 298' therebetween, for anchoring purposes, as in FIG. 26.

Thereafter, the filled brush, made up to desired length by multiple interfitting sections as described, is removed off the mandrel 206, shipped to the customer, and mounted on a drive shaft for use, as described above in regard to FIG. 22.

FIG. 27 shows a modified synthetic resin core 250 supported on a metallic tube 205. The hole formation, and bristle filling, under control of the computer 100, are carried out to form multiple clusters of bristles, indicated for example at 251–253, the clusters separated lengthwise of the core. (See gaps at 254 and 255). Note the larger gaps or spaces "$s_1$", between successive holes and bristles therein. Operation of control 100 enables a wide range of hole group or cluster positions, and spacings between holes in each group. Also, the process enables use of different type bristles on the same core, as for example steel, natural fiber, and synthetic fiber; and different colored bristles may also be employed. For example, each of the bristle clusters 251–253 may have different colors.

Accordingly, during forming of the holes in a core, the hole spacing and spiral angularity (about axis 202) may be easily changed or selected, through use of the process.

In FIGS. 28–30, a multiple section sleeve 390 has a mid-section 390*a*, and sections 390*b* attached thereto in telescoping relation. See overlapping annular extents 391 and 392. The sections consist of tough synthetic resin such as ABS, and they are bonded together at the telescoping overlap 393. A steel mandrel 394 is received into the sleeve 390 to mount and support the sleeve for rotation as for example when a number of telescoping sections are made up to form an elongated brush. Fasteners 395 removably attach the sleeve to the mandrel as at opposte ends of the brush. This allows the user to replace a used brush simply by attaching a replacement sleeve to his mandrel, at the job site. See fastener openings at 396*a* and 396*b* in the sleeve and mandrel. Drilled openings 397 receive bristles 398, and staples 399 anchor the bristles in position, as described in FIGS. 21–27. The staple legs 399*a* are deflected laterally by the steel mandrel to extend adjacent the bore of the sleeve.

Drive or support axles 400 extend axially endwise into the co-axial sleeve and mandrel, and plates or webs 401 are attached to the axles and to the steel mandrel. FIG. 30 shows locations of holes 397 to be drilled in the sleeve sections, along their lengths. FIG. 30 is a developed view.

In FIG. 31, the sleeve 490 also consists of telescoping synthetic resin sections. including a mid-section 490*a* and end sections 490*b* telescopically fitted and attached to the section 490*a*. See overlapping annular extents 491 and 492; again, the sections may advantageously consist of ABS, and may be bonded at overlap 493. In this example, no steel mandrel or core is provided, the sections being sufficiently thick, and the brush being short enough, that support is not required. Drilled openings for anchored bristles appear at 496, and are formed and filled with bristles as in FIGS. 21–28, the hole pattern being shown in FIG. 33. FIG. 34 shows staples 480 having legs 480*a*, and anchoring the bristles 481 in position. Openings 482 deliver fluid from the sleeve interior to the bristles and their openings 496, as will be discussed in connection with FIG. 35. FIG. 33 is a developed view.

Alternatively, or additionally, drilled openings 485 may be formed at locations along the sections, to extend between bore 486 and outer surfaces 497. They deliver fluid from the sleeve interior to the sleeve exterior as discussed in FIG. 5. The openings have flared mouths 485*a* to eject fluid laterally toward adjacent bristles, to assist their scrubbing action. Fluid may be supplied to the sleeve interior 478 via passage 474 in cap 497.

Also provided are end caps 497, attached, as by bonding, to opposite ends of the sleeve 490, as shown. Axles 498 are attached to the caps and support the brush. Rotary drive may be transmitted to the brush as via structure 483 connected to an axle.

In FIG. 35, fluid under pressure is supplied to the interior 589 of sleeve 590, to escape outwardly as via radial ports 591 spaced from bristles 592, and/or via radial ports 593 extending to the bristles and their anchor holes 594. In the latter case, the fluid may be employed to clean the bristles, and may consist of washing fluid, such as a suitable detergent in water.

The sleeve 590 comprises synthetic resin sections 590*a* and 590*b*, as described in FIGS. 30 and 31, and which have telescopic interconnection, as at 596. The opposite ends of the tubular sleeve ar closed by end caps 598 and 599 bonded to the sleeve ends, as at 598*a* and 599*a*.

The means to supply fluid under pressure may include a tubular axle shaft 604 connected to the end caps as by welding 605. Axle 604 is also rotatably driven, as for example by a sprocket 606 on the axle, and a chain engaging the sprocket. A pillow block 607 supports the axle. Fluid is delivered to the rotatable end 604*a* of the axle from the end 609*a* of a non-rotary pipe 609, both ends located within a sealed gland 610. Holes 611 in the tubular axle deliver the pressurized fluid to the interior 589 of the sleeve, for entry to the escape ports referred to. A selector valve 613 has a control 614 to control which of several fluids delivered to the valve, as at 615–617, is to be passed to pipe 609. Such fluids may include:

(i) washing fluid, as for cleaning fruit or vegetables,
(ii) fluid wax, as for waxing fruit,
(iii) drying air.

FIG. 36 shows a group of the brushes 700, of the type shown in FIG. 33. Fluid is supplied to the elongated, parallel, rotating brushes, and dispersed directly to the articles 701 (fruit or vegetables) traveling over the brushes as they rotate. See arrows 720. An enclosure 702 houses the brushes, and a tray 703 collects the liquid fluid and removed soils. FIG. 36*a* shows sequential processing, by groups of brushes as described. Washing fluid is supplied at 704 to group 705; drying air is supplied at 706 to groups 707; and fluid wax is supplied at 708 to group 709. Fruit or vegetables pass over the brush groups 705, 707, and 709, in sequence, as indicated by arrows 710.

In FIG. 37, a group 711 of fluid supplied brushes is moved relatively over stationary articles 712, such as circuit boards, during cleaning thereof, and an enclosure 713, houses the brushes.

We claim:

1. In a brush filling process employing a first core sleeve consisting of synthetic resin defining a bore, bristles, and staples, the sleeve having an outer surface and an axis, the steps that include (a) forming holes in the core sleeve to extend inwardly from the outer surface of the sleeve, and in a preselected pattern spaced lengthwise of the core and about the core sleeve axis,
(b) filling said bristles into said holes to be retained at the bottoms of said holes, and to project outwardly from said holes, and
(c) driving said staples into the core sleeve inwardly of the bottoms of the holes, thereby retaining the bristles to the hole bottoms, the staples having legs with end portions,
(d) and wherein the core sleeve comprises multiple sleeve sections, and including telescopically interfitting said sections, thereby forming the core sleeve to selected length,
(e) and including deflecting the end portions of the staple legs to extend generally tangentially of the sleeve bore, thereby anchoring the staples to the core sleeve, said process also including employing three of the core sleeves and longitudinally axially spaced rotary heads, and the process including the further steps:
  (i) releasably coupling said three core sleeves to two of the heads, with the core sleeves spaced about a working axis defined by said heads,
  (ii) rotating at least one of the heads about said working axis, thereby rotating the cores between index positions,
  (iii) carrying out said hole forming step at one of said positions, (iv) subsequently carrying out said bristles filling step, said staple driving step and said staple end deflecting step at a second of said positions, (v) further including trimming the filled bristles at a third of said positions (vi) simultaneously rotating the cores at said first and second positions relative to the heads whereby said holes are formed at cicularly spaced locations, and said bristles are filled into the holes, (vii) and independently transmitting drive through one of said heads to the core at said third position thereby effecting rapid rotation of said core at said third position, while said rotation of the cores between index positions is stopped.

2. The process of claim 1 wherein the bristles are selected from the group consisting of:

(i) steel (ii) natural fiber (iii) synthetic fiber.

3. The process of claim 1 wherein the sections are telescopically interfitted on a mandrel extending therein and said steps (b) and (c) at the telescoping extents of the sections are completed after said interfitting, and in such manner as to cause the staples to interlock said telescoping extents.

4. The process of claim 3 wherein said holes are formed in the telescoping outer and extent but not in the telescoping inner end extent.

5. The process of claim 3 wherein said holes are formed in said sections to spiral about the core sleeve axis with spiral continuity from one section to the next, across said telescoping end extents when the sections are in said telescoping relation.

6. The process of claim 3 including removing the mandrel from said core sleeve so that the sleeve may sequently be mounted on a rotary shaft or rod for rotation during use of the brush.

7. The process of claim 1 wherein said (i) step includes mounting the core sleeve on a mandrel that extends adjacent to the core sleeve bore, said deflecting step carried out by driving the staple leg end portions against the mandrel which deflects them adjacent the mandrel and tangentially of the sleeve bore, but within the sleeve material.

8. The process of claim 7 including removing the core sleeve from the mandrel so that the core sleeve may subsequently be mounted on a rotary shaft or rod for rotation during use of the brush.

9. The method of claim 8 including providing end caps and attaching said end caps to opposite ends of the sleeve, and providing a drive axle, and attaching the axle to at least one of the end caps.

10. The process of claim 1 including providing a metallic drive tube, extending the tue into the sleeve, and attaching sleeve to the tube.

11. The process of claim 1 wherein the sleeve consists of ABS.

12. The method of claim 1 wherein the heads include first and second heads interconnected by rods and an auxiliary head slidable along said rod, and including the step of adjusting the position of the auxiliary head along the rods to accomodate of releasable coupling of three core sleeves to said two of the heads which are said auxiliary head and said second head.

* * * * *

UNITED STATES PATENT AND TRADEMARK OFFICE

CERTIFICATE OF CORRECTION

PATENT NO. : 4,779,932

DATED : October 25, 1988

INVENTOR(S) : Anthony C. Boland, & George R. Maxwell

It is certified that error appears in the above-identified patent and that said Letters Patent is hereby corrected as shown below:

Column 11, Claim 4, line 28; "formed in the telescoping outer and extent but not in the" should read --formed in the telescoping outer end extent but not in the--

Column 12, Claim 10, line 23; "metallic drive tube, extending the tue into the sleeve," should read --metallic drive tube, extending the tube into the sleeve,--

Column 12, Claim 10, line 24; "and attaching sleeve to the tube." should read --and attaching the sleeve to the tube--

Signed and Sealed this

Eighth Day of August, 1989

*Attest:*

DONALD J. QUIGG

*Attesting Officer*

*Commissioner of Patents and Trademarks*